US007625193B2

(12) United States Patent
Chadwick

(10) Patent No.: US 7,625,193 B2
(45) Date of Patent: Dec. 1, 2009

(54) RADIAL AXIS, SPHERICAL BASED ROTARY MACHINES

(75) Inventor: Lee S. Chadwick, Casselberry, FL (US)

(73) Assignee: Searchmont LLC., Marietta, GA (US)

( * ) Notice: Subject to any disclaimer, the term of this patent is extended or adjusted under 35 U.S.C. 154(b) by 0 days.

(21) Appl. No.: 12/207,377

(22) Filed: Sep. 9, 2008

(65) Prior Publication Data

US 2009/0068050 A1 Mar. 12, 2009

Related U.S. Application Data

(60) Continuation of application No. 12/168,654, filed on Jul. 7, 2008, which is a division of application No. 11/378,118, filed on Mar. 16, 2006, now abandoned.

(60) Provisional application No. 60/662,941, filed on Mar. 16, 2005.

(51) Int. Cl.
*F03C 4/00* (2006.01)
*F04C 18/00* (2006.01)
*F02B 53/00* (2006.01)

(52) U.S. Cl. ..... 418/196; 418/204; 418/183; 418/209; 123/218; 123/232; 123/233

(58) Field of Classification Search ..... 418/196, 418/197, 204, 15, 183, 206.4, 209; 123/218, 123/232, 233
See application file for complete search history.

(56) References Cited

U.S. PATENT DOCUMENTS

| | | | | |
|---|---|---|---|---|
| 710,756 | A | 10/1902 | Colbourne | |
| 1,349,882 | A | 8/1920 | Homan | |
| 1,874,239 | A * | 8/1932 | Cannizzaro | 418/196 |
| 2,097,881 | A | 11/1937 | Hopkins | |
| 2,410,341 | A | 10/1946 | Delamere | |
| 3,129,460 | A | 4/1964 | Berger | |
| 3,207,425 | A | 9/1965 | Morse | |
| 3,234,888 | A | 2/1966 | Wise et al. | |
| 3,439,654 | A | 4/1969 | Campbell, Jr. | |
| 3,518,975 | A | 7/1970 | Schmidt | |
| 3,751,193 | A | 8/1973 | McCall | |

(Continued)

FOREIGN PATENT DOCUMENTS

| | | |
|---|---|---|
| DE | 3241253 | 5/1984 |

(Continued)

*Primary Examiner*—Thomas E Denion
*Assistant Examiner*—Mary A Davis
(74) *Attorney, Agent, or Firm*—Wilmer Cutler Pickering Hale & Dorr LLP.

(57) ABSTRACT

A rotary machine including: a housing; a plurality of rotor spindles aligned along three orthogonal axes; rotor blades on the rotor spindles and arranged relative to each other so that each rotor blade is in tangential sliding contact with at least two other rotor blades and forming a plurality of working chambers each having a volume which changes as the rotor spindles rotate; a gear system including a plurality of internal bevel gears on the ends of the plurality of rotor spindles and for synchronizing rotation of the rotor spindles during operation; and a central valve mechanism with the rotor spindles extending radially outward therefrom and around which the rotor blades are arranged, wherein the central valve mechanism controls flow of a fluid to at least some of the working chambers formed by the rotary blades.

17 Claims, 38 Drawing Sheets

U.S. PATENT DOCUMENTS

| | | | | |
|---|---|---|---|---|
| 3,799,126 | A | | 3/1974 | Park |
| 3,809,026 | A | | 5/1974 | Snyder |
| 3,810,723 | A | | 5/1974 | Johnson |
| 3,966,371 | A | | 6/1976 | Berzanske |
| 3,990,410 | A | | 11/1976 | Fishman |
| 4,021,158 | A | | 5/1977 | Bajulaz |
| 4,324,537 | A | | 4/1982 | Meyman |
| 4,782,802 | A | | 11/1988 | Koromilas |
| 4,877,379 | A | | 10/1989 | Okabe |
| 4,934,325 | A | * | 6/1990 | Snyder ..... 418/196 |
| 4,979,882 | A | | 12/1990 | Wipf |
| 5,271,364 | A | | 12/1993 | Snyder |
| 5,341,782 | A | | 8/1994 | McCall et al. |
| 5,404,849 | A | | 4/1995 | Fenton |
| 5,860,802 | A | | 1/1999 | Densch |
| 6,139,290 | A | | 10/2000 | Masterson |
| 6,224,358 | B1 | | 5/2001 | Muser |
| 6,604,503 | B2 | | 8/2003 | Mekler et al. |
| 7,527,485 | B2 | * | 5/2009 | Coffland ..... 418/196 |

FOREIGN PATENT DOCUMENTS

| | | | |
|---|---|---|---|
| DE | 3709014 | | 7/1988 |
| DE | 3905882 | | 9/1990 |
| DE | 3905882 | A1 * | 9/1990 |
| DE | 19738132 | | 9/1999 |
| FR | 2652391 | | 3/1991 |
| GB | 2273317 | | 6/1994 |
| JP | 61038184 | | 2/1986 |

* cited by examiner

RADIAL AXIS, SPHERICAL BASED ROTARY MACHINES

This application is a continuation of U.S. patent application Ser. No. 12/168,654, filed Jul. 7, 2008, which was a divisional of U.S. patent application Ser. No. 11/378,118, filed Mar. 16, 2006, which claims the benefit of U.S. Provisional Application No. 60/662,941, filed Mar. 16, 2005.

BACKGROUND OF THE INVENTION

The concepts of the present invention encompass a form of rotary machines embodying parallel and splayed axis shafts with eccentric and non-eccentric rotors. In the prior art, the axis of rotation is through the geometric center of the rotor, thereby limiting the possible configurations. Typical rotary engine patents use parallel axis configurations meaning that the axes of rotation are parallel to each other and all rotors rotate in a planar circular arc perpendicular to these axes. The shifting of the center of rotation away from the center of geometry (i.e., eccentricity) allows for multiple rotor configurations (four, five, and six). This concept of eccentricity has remained unused in rotor design because no one has sought to modify the basic philosophy of the prior Colbourne rotary concept and its relative uniqueness and simplicity. Of the many innovations that extend from the Colbourne concept, none of them have strayed from the fundamental concept of the Colbourne theme.

In addition, and related to this concept of eccentricity, is the concept of radial axis machines where the axis of rotation is skewed or tilted in a radial pattern around a central fixed axis. The tilting of the axis causes varying degrees of eccentricity to occur in the rotor design. This skewing condition of the axes culminates when the radial axes are perpendicular to each other at 90 degrees and eccentricity is zero. Moving from parallel axis to radial axis machines, where the axis of rotation is not parallel to the axes of adjacent rotors, allows for a greater diversity of rotary machines not before envisioned. This movement of the axis from parallel to radial generates machines where the rotors do not rotate on a plane but rotate on spherical surface.

History shows multiple patents that describe three or four rotor machines that are all based on parallel axis. This creates a machine where all rotors are revolving about parallel axis shafts and their construction geometries and rotational movements are on a planar surface. In addition, the axis of rotation falls directly through the center of the rotor shape (zero eccentricity). This limits the possible configurations to groupings of three or four rotors. Due to the geometries involved with keeping the rotors tangent to each other as they rotate through 360 degrees, parallel axis machines with a single volume chamber cannot be defined with more than four rotors. This does not mean that they can not be placed together in adjacent groupings to create more than one chamber, but in all cases, there can not be more than four rotors either applying work to or extracting work from the cycle of the machine.

In an eccentric configuration, the axis is moved off the center of the oval shaped rotor (referred to as eccentricity). This results in an extension of the four-rotor design and allows for the creation of five- and six-rotor configurations where six is the maximum practical configuration. Although seven rotors and above is geometrically possible, the resulting rotor configuration is not practical, since the resulting shape would not allow for a reasonable mechanical configuration. For example, the inclusion of an output shaft.

In the past, four-rotor design has been the basis for rotary machines. The introduction of eccentricity allows for five and six flat or planar rotor configurations. Five and six rotor configurations expose more surface area to the chamber, thereby increasing their possibility to do work for each machine cycle which also use the "teardrop" shape rotor where one tip has a radius and the other tip forms a vertex. These five- and six-rotor configurations create a natural port as the rotors move through their cycle.

It is true that the four-rotor configuration could be scaled or have multiple groupings to equal this work gain, but that would require a significant increase in machine size. Thus the five- and six-rotor rotary machines are far more efficient for a given physical size.

Although this machine depicts a typical arrangement for an engine configuration, this concept of eccentric rotors on a rotary machine could apply to other embodiments such as pumps. To get the rotors to work in unison and in co-rotation, a gear set is required that provides the phasing of the rotors to produce the working chamber.

Eccentricity in Rotor Definition

The concept of eccentricity in rotor definition has not been used because no one has sought to modify the basic philosophy of the Colbourne rotary concept from its relative uniqueness and simplicity. Of the many innovations that extend from the innate beauty and simplicity of the Colbourne concept, none have strayed from the fundamental concept of the Colbourne theme until the ideas set fourth in this document.

The introduction of eccentricity into the rotary configuration creates the following benefits over existing parallel axis configurations: The dynamic (moving) porting simplifies the methods of engine cycling; Allows for multiple (4+) rotor configurations, operating in both parallel axis and non parallel axis configurations; Increased torque outputs due to the induced lever arm created from the offset axis; Increased work output due to the increased surface area the multiple rotors (4+) permit for a given chamber volume; Reduced physical size required to configure the machine; Larger chamber volumes for a given physical size; Easy assembly using bevel gears.

For parallel axis systems, the rotors are all moving on planes perpendicular to the axis of rotation.

The introduction of a radius tip at one or both ends of the rotor affects the eccentricity, thereby shifting the rotor rotation axis from the center of the rotor geometry. The addition of a radius tip causes several desirable outcomes: Radius tips create a chamber volume, which can be altered in size based on the application of the machine; A radius tip produces a complimentary surface that as the rotors interact with each other, there is more surface area in tangential contact rather than a singular vertex; A radius tip also creates a region of the rotor suitable for the placement of a load-bearing crankshaft.

Radial axis configurations of the rotary engine have also not been exploited in the past. Parallel axis embodiments are the common machine configuration. The introduction of eccentricity into the basic four-rotor configurations has allowed the creation of five- and six-rotor rotary machines. Eccentricity also allows us to move to radial axis configurations where the axis of rotor shafts are not parallel, but can be splayed from a central axis to form a right circular cone.

When one introduces a radial angle into the axis of rotation, the rotors can no longer operate in a planar or flat environment but must now rotate relative to a spherical surface. This radial angle or "splaying" of the shafts off of parallel introduces an eccentricity formed at the apex angles by the mapping of standard flat shapes (squares, pentagons and hexagons) onto spherical surfaces. Eccentricity is now formed naturally due to the radial array unlike in the flat conditions where one has the option to introduce it into their design. When dealing with radial arrays and spherical surfaces, there is a solution where the tip radius will maintain tangential contact with the sides of the adjacent rotor as it passes through its 360-degree cycle for any given amount of eccentricity due to apex angle and tip radius.

The addition of a radial tip is essential in the creation of a machine. As discussed previously, the radius tip allows for a volumetric area for either combustion or pump activities. The construction process is the same for the six-rotor lobe as it is for all other rotor designs. As with all other configurations described in this document, the resultant curve for the "long" side of the rotors is not a second order constant radius arc. It is a third order spline. Failure to describe it as such will yield rotor designs that will not work in "real life" applications.

SUMMARY OF THE INVENTION

A rotary machine having a plurality of rotor spindles conically arranged. An internal combustion machine: Having a plurality of rotor blades; Having a plurality of rotor spindles; Where each rotor blade has a rotor spindle attached thereto; the rotor spindles rotating about their centerlines; Where the centerlines of the rotor shafts are configured to lie on the surface of an imaginary cone.

A rotary machine utilizing a beveled planetary gear driven by rotor spindle pinion gears. An internal combustion machine: Having a plurality of rotor blades; Having a plurality of rotor spindles. Where each rotor blade has a rotor spindle attached thereto; the rotor spindles rotating about their center lines; Where the rotor spindles have pinion gears configured to mate with and turn a beveled (or conical) planetary gear mounted or formed on an output shaft.

A rotary machine having a plurality of rotor blades where the upper surface of the rotor blades lies on the surface of an imaginary sphere. An internal combustion machine: Having a plurality of rotor blades; Having a plurality of rotor spindles. Where each rotor blade has a rotor spindle attached thereto; the rotor spindles rotating about their centerlines; Where the top surfaces of the rotor blades lie on the surface of an imaginary sphere.

A rotary machine having rotor blades rotating about an axis that is offset from the center of the cross-sectional area of the blade. An internal combustion machine: Having a plurality of rotor blades; Where each rotor blade has a rotor spindle attached thereto; the rotor spindles rotating about their centerlines. Where the rotor spindles are attached to the rotor blades at a point that is offset from the center of the cross sectional area of the rotor blades.

A rotor blade for a rotary machine having a near "teardrop" shaped cross-section. The cross section is roughly an ellipse but with one pointed end. Changes to the shape of the cross section allow for the control of the compression ratio of the machine.

The invention comprises a rotary engine or pump having a plurality of rotor blades. The engine components may be constructed of ceramic or metal or composites thereof. Rotor shafts or spindles extend through each of the rotor blades (one rotor spindle per rotor blade). The rotor blades are housed in an area defining a combustion chamber. The combustion chamber is sealed with the exception of exhaust and intake ports and any orifices needed for ignition related elements.

The centerlines of each of the rotor spindles are canted at an angle from vertical, with each centerline lying of the surface of an imaginary cone. The top surface of each of the rotors is curved. The curvature matches that of the surface of a sphere of a given radius. The cross sectional area of the rotor blades gradually reduces/tapers from a maximum at the top of the blades to a minimum at the bottom of the blades—that is the blade are larger at the top than at the bottom. The rotor blades are fixed to the rotor spindles such that when the rotor blades rotate, so do their respective spindles. The rotor blades rotate about the centerlines of the rotor spindles.

The rotor blades of the five-rotor design have a "tear-drop" shaped cross-section. Also, in the five-rotor deign, the rotor blades are mounted to the rotor spindle at a point offset from the center of the cross sectional area of the blades (the cross section lying in a plane orthogonal to the rotor spindle centerline). In contrast, the rotor blades of the four-rotor design are mounted to the rotor spindles at the center (or nearly so) of the cross sectional area of the rotor blades and the rotor blades are symmetrical on either side of the rotor spindle with the exception of a small flat "notch" on one side of the rotors. The shapes of the rotor cross sections in both designs are derived from segments of second and third order curves.

The top of the rotor spindle extends beyond the rotor blade for a distance sufficient to allow for the installation of a bearing to hold the centerline of the shafts substantially stationary while allowing the spindles to rotate. A conical shaped bearing comprising a number of tapered needle bearings may be used to allow the spindles to rotate freely.

The lower or distal ends of the rotor shafts have tapered gears mounted thereto or formed thereon. The tapering of the gears is matched to the tapering of a planetary gear on an output shaft. A conically shaped sun gear sits in the center of the rotor spindles and holds the spindles in place against the output shaft. This gearing is configured for zero (or minimal) backlash operation. Any torque generated by forces applied to the rotor blades is therefore transferred through the rotor shafts to the central output shaft.

The gearing at the end of the rotor shafts also ensures that the rotor blades rotates synchronously. The timing of the rotor blades is adjusted so that during their rotation (or during a portion of their rotation in the five-rotor designs) each of the rotor blades is in contact (or nearly so) with an adjacent rotor blade. A volume inside the engine between the rotor blades is isolated. As the blades continue to rotate, the isolated volume decreases until a minimum volume is reached. After the point of minimum volume is reached, further rotation results in the isolated volume expanding in size. In the five-rotor design, the isolated volume is eventually released as the rotor blades continue to rotate.

In operation as an engine, a fuel mixture is introduced through an intake port. The fuel mixture is preferably hydrogen and oxygen, but a petroleum vapor (gasoline, etc.) and air mixture can be used. As the rotor blades rotate to form the isolated volume, the isolated volume then contains the fuel mixture. The fuel mixture is compressed as rotation continues until the point of greatest compression occurs. Just beyond the point of greatest compression, the isolated volume begins to expand and the fuel mixture is ignited. Ignition is preferably achieved through the use of a laser directed from the top center of the combustion chamber. The use of a laser can provide a cylindrical wave front for the resulting combustion as opposed to a spherical wave front that would be produced if a conventional point source of ignition were used. Spark plugs can, however, be utilized as well as other ignition methods, such as dieseling. The conical wave front combustion is preferred since the combustion forces would provide a more uniform pressure to the faces of the rotor blades.

As combustion progresses, the rotor blades are forced to turn as the isolated volume expands. After full expansion has occurred, an exhaust port is opened to allow the gasses inside the combustion chamber to escape. The cycle then begins again.

The engine may be configured as a two or four cycle engine or as a pump or compressor.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Four-Rotor, Four-Cycle Engine

The splayed axis, four-rotor, four-cycle engine is illustrated in FIGS. 1-13 but the machine may be configured as a two- or four-cycle machine. In addition, it may be configured to perform as a pump.

The present invention comprises a rotary machine having a plurality of rotor blades (at least three) driven by the combustion of a fuel mixture. The machine components may be constructed of ceramic or metal or composites thereof. Rotor shafts or spindles extend through each of the rotor blades (one rotor spindle per rotor blade). The rotor blades are housed in an area defining a combustion chamber. The combustion chamber is sealed with the exception of exhaust and intake ports and any orifices needed for ignition related elements.

Figure 1:
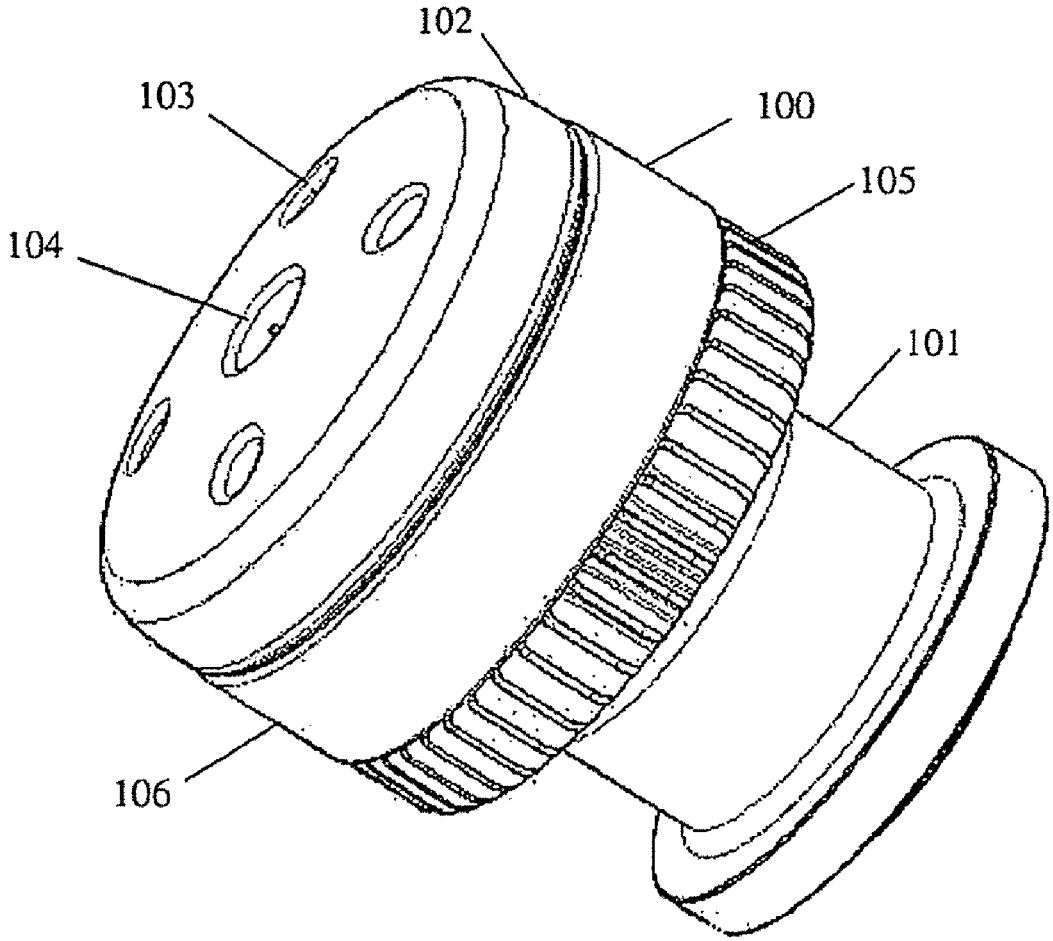
FIG. 1 is a perspective view of a four-rotor, four-cycle engine embodiment.

FIG. 1 depicts a preferred embodiment of a multiple rotor machine based on a splayed or radial axis design. This depiction is based on a four-rotor configuration but many of the same principles will be the same for a five and six-rotor version.

Referring specifically to FIG. 1-13, a four rotor, four cycle engine 100 is illustrated having a casing 101 and a head cover 102 and having intake ports 103 and a spark plug access 104.

Figure 2:
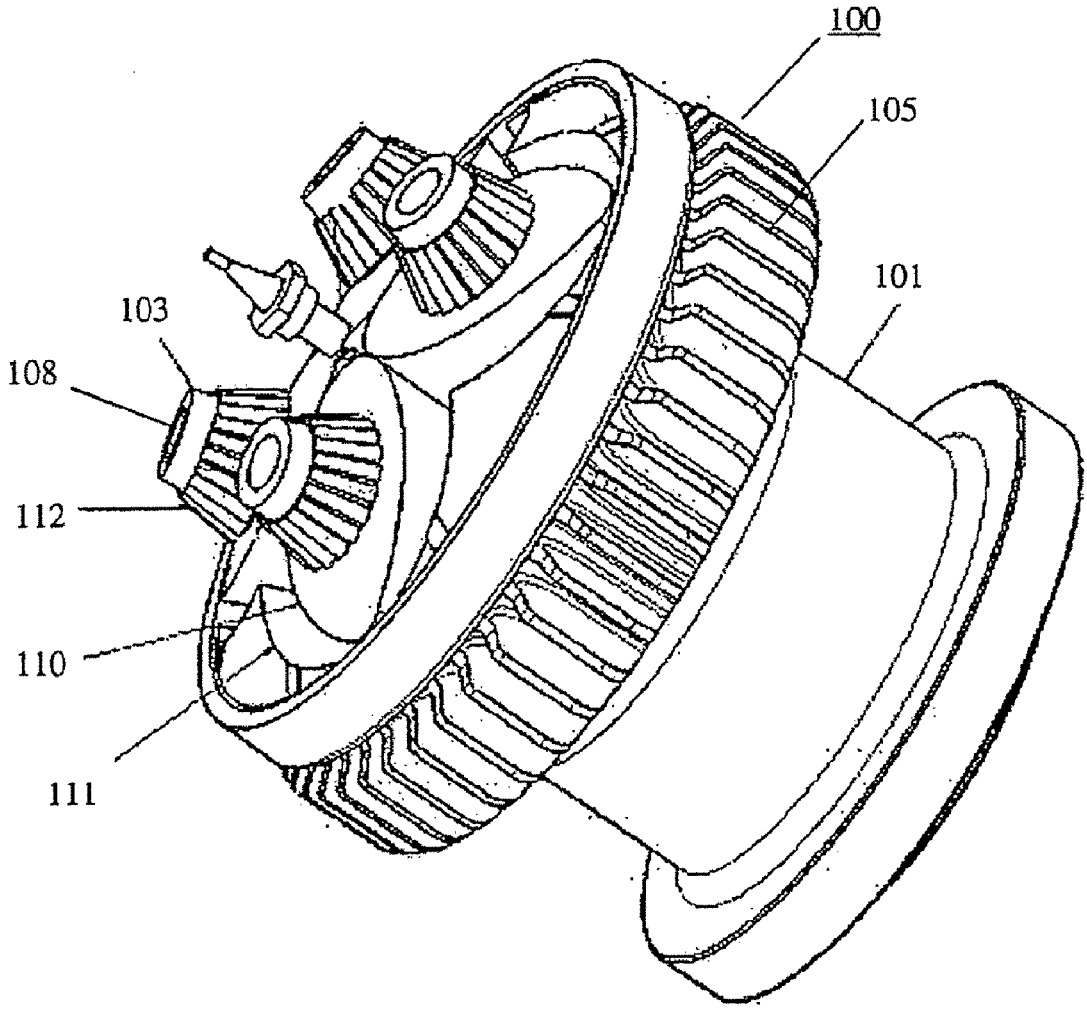
FIG. 2 is a perspective view of a four-rotor, four-cycle engine embodiment with top removed.
Figure 3:
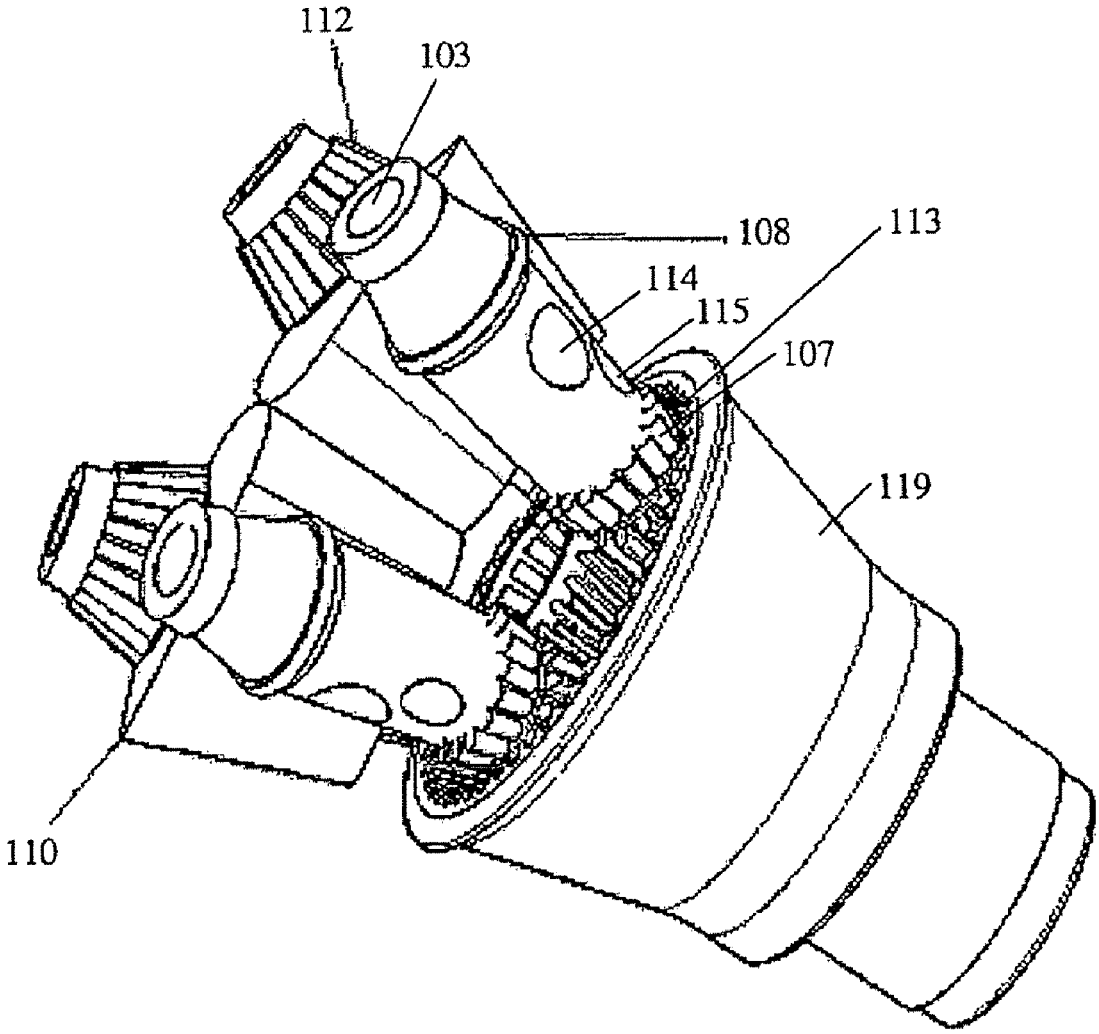
FIG. 3 is a perspective view of a four-rotor, four-cycle engine without mid casing and several rotors.
Figure 4:
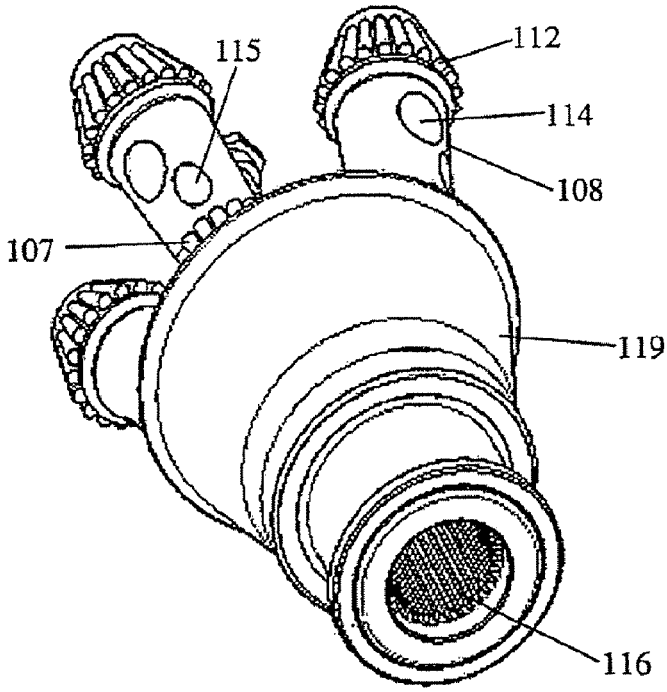
FIG. 4 is a perspective view of a four-rotor, four-cycle engine drive gear.
Figure 5:
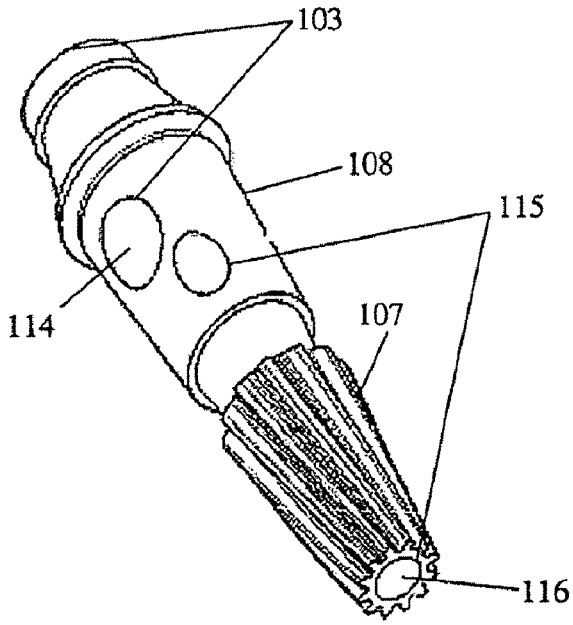
FIG. 5 is a perspective view of a rotor shaft showing intake and exhaust ports.

The casing 101 has cooling fins 105 and a casing band 106 with the head removed as seen in FIG. 2. The four pinion gears 107 can be seen each connected to the end of a shaft 108 and each shaft 108 has a rotary piston 110 attached thereto rotating inside the cylinder walls 111 and forming a combustion chamber 109. Each shaft 108 has a generally cone-shaped roller bearing 112 also affixed to one end thereof. Intake ports 103 can be seen as extended through the shafts 108 and are splayed from the center of the bottom of each shaft having the pinion gear 107 attached thereto and riding in a sun gear 113 of the output shaft 119. Shafts 108 have inlet openings 114 extending therefrom and an exhaust port 115. Air and fuel enters into the shaft inlet 103 in the shaft 108 and egresses therefrom at 114 passing through one of the rotary pistons 110 and through exhaust port 115 and out exhaust 116, as seen in FIG. 5.

The centerlines of each of the rotor spindles are canted at an angle from central axis, with each centerline lying on the surface of an imaginary cone where the imaginary cone has a vertex angle less than 180 degrees and more than 0 degrees.

Figure 6:
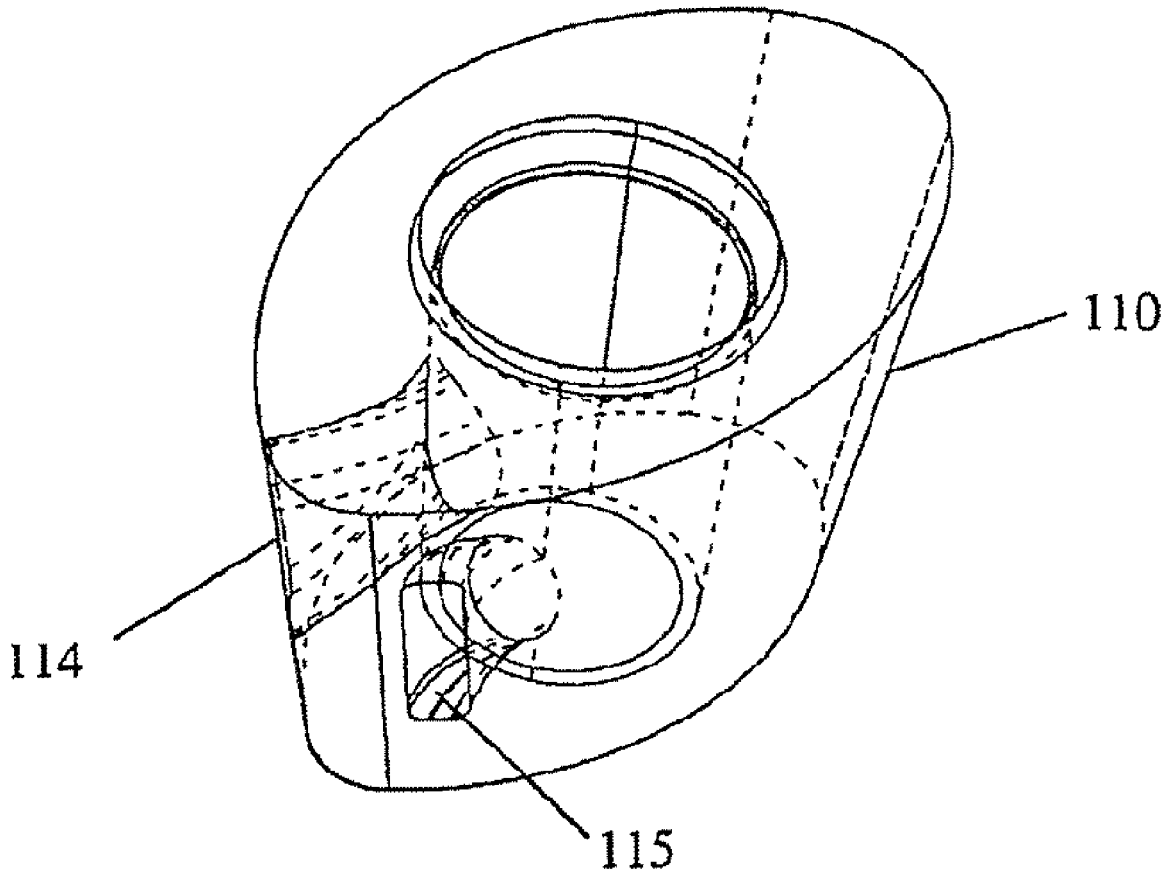
FIG. 6 is a perspective view of a rotor showing intake and exhaust ports.
Figure 7:
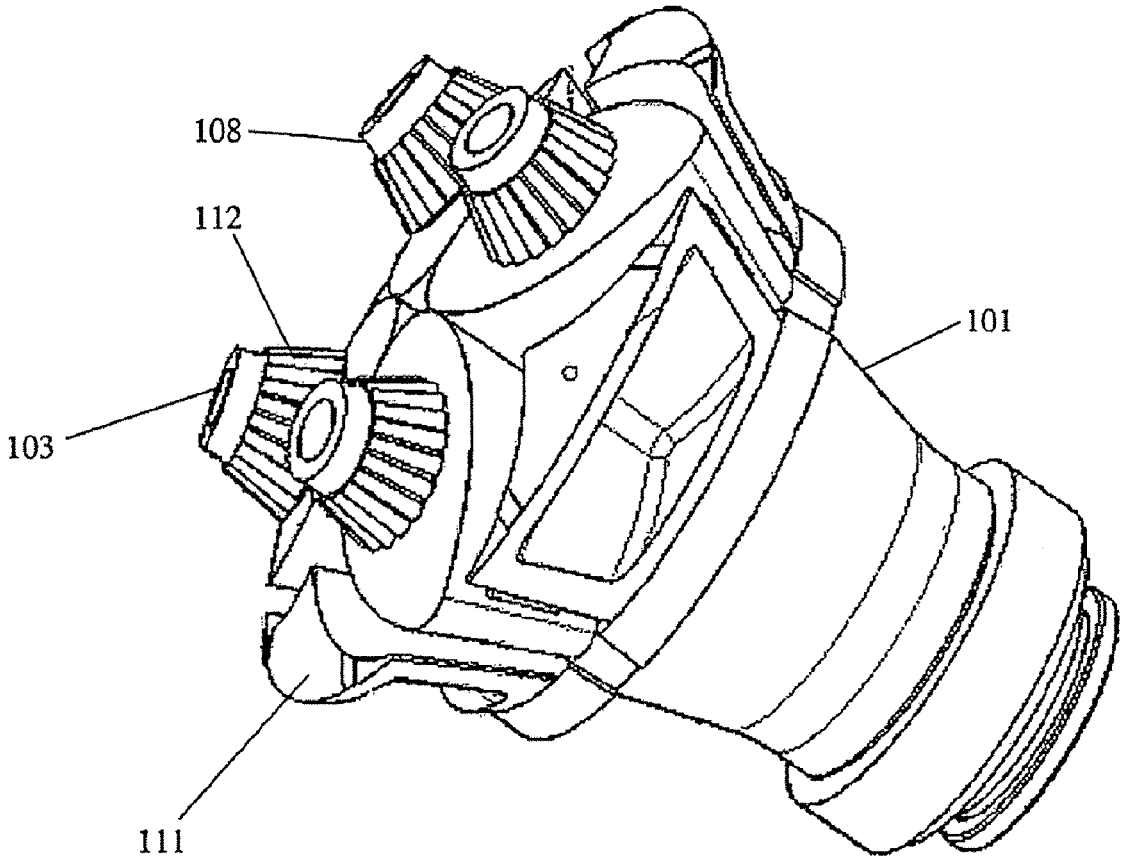
FIG. 7 is a perspective view of a four rotor, four cycle engine without top and mid casing.

The rotor blades of the four-rotor design have an "oval" shaped cross-section as can be seen in FIGS. 1-7. An isolated view of a rotor blade of the four-rotor design is shown in FIG. 6. In all of the radial designs, the top surfaces of the rotors are curved. The curvature matches that of the surface of a sphere of a given radius. The cross sectional area of the rotor blades gradually reduces/tapers from a maximum at the top of the blades to a minimum at the bottom of the blades—that is the blades are larger at the top than at the bottom (as can be seen in FIGS. 1-7).

The rotor blades are fixed to the rotor spindles such that when the rotor blades rotate so do their respective spindles. The rotor blades rotate about the centerlines of the rotor spindles. In the four-rotor design, the rotor blades are mounted to the rotor spindles at the near center (slight eccentricity) of the cross sectional area of the rotor blades, and the rotor blades are near symmetrical with a small notch on one end of the rotors. In the five-rotor design, the rotor blades are mounted to the rotor spindles at a point significantly offset from the center of the cross sectional area of the blades (the cross section lying in a plane orthogonal to the rotor spindle centerline). The shapes of the rotor cross sections in both designs are custom designed based on splay angle, tip radius, sphere radius, and the number of rotors as shown in previous discussions.

The top of the rotor spindle extends beyond the rotor blade for a distance sufficient to allow for the installation of a bearing to hold the centerline of the shafts substantially stationary while allowing the spindles to rotate. A conical shaped bearing comprising a number of tapered needle bearings may be used to allow the spindles to rotate freely.

The lower or distal ends of the rotor shafts have tapered gears mounted thereto or formed thereon. The tapering of the gears is matched to the tapering of a planetary gear on an output shaft. The tapered pinion gears on the rotor spindles fit inside a "cupped" area of the output shaft. A conically shaped sun gear sits in the center of the rotor spindles and holds the spindles in place against the output shaft. This gearing is configured for zero (or minimal) backlash operation. Any torque generated by forces applied to the rotor blades is therefore transferred through the rotor shafts to the central output shaft.

The gearing at the end of the rotor shafts also ensures that the rotor blades rotate synchronously. The timing of the rotor blades is adjusted so that during a portion of their rotation each of the rotor blades is in contact (or nearly so) with an adjacent rotor blade.

Figure 8:
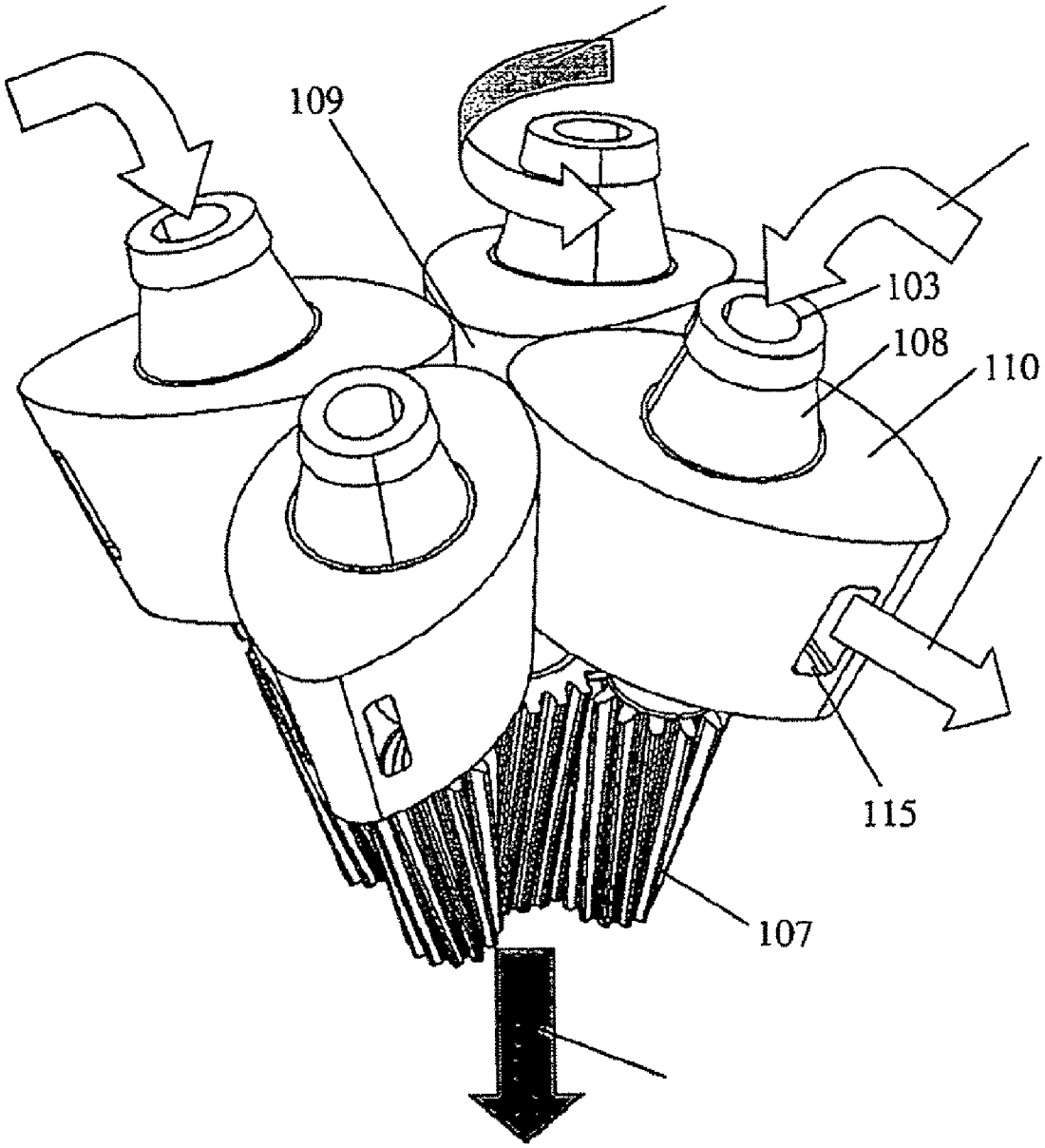
FIG. 8 is a perspective view of an overview of four cycle operation.
Figure 9:
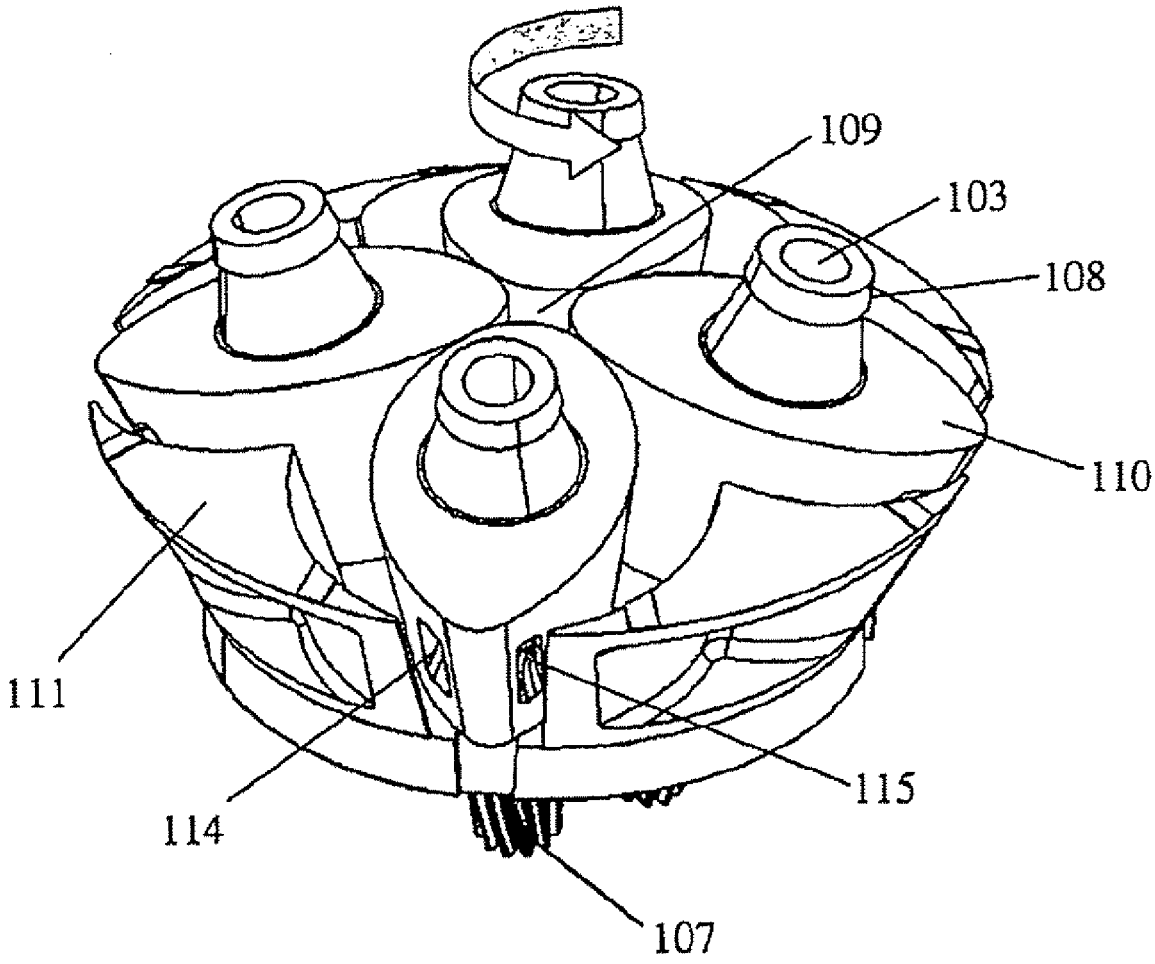
FIG. 9 is a perspective view of a basic cycles—0 degrees.

The engine operation described below is, a four rotor, radial axis rotary engine configured to run in a four-cycle (stroke) configuration. Due to the radial axis configuration, the rotors are rotating on a spherical surface, and due to the eccentricity, the axis of rotation is offset from the center of the rotor shape creating a larger lever arm to perform work on during the combustion process. As the rotors rotate about their axis through 360 degrees, they create a variable sized chamber that undergoes compression and exhaust cycles. Power from the process is passed through beveled planetary gear set which is connected to a Power Take Off (PTO) ring gear which can then be attached to other devices such as transmissions, pumps, etc. as required. Intake and exhaust gases flow through the main pinion shafts and due to the placement of the intake and exhaust ports on the rotors themselves, we simplify the porting of this engine. Intake gases come in from a manifold affixed to the top of the engine case and exhaust gases are expelled down the same pinion shafts and out through the PTO. This process is illustrated in FIG. 8.

In operation, (this description refers to the four-rotor design) a fuel mixture is introduced through an intake port. The fuel mixture is preferably hydrogen and oxygen, but a petroleum vapor (gasoline, etc.) and air mixture can be used. As the rotor blades rotate to form the isolated volume, the isolated volume then contains the fuel mixture. The fuel mixture is compressed as rotation continues until the point of greatest compression occurs. Just beyond the point of greatest compression, the isolated volume begins to expand and the fuel mixture is ignited. Ignition is achieved through the use of a spark plug fired from the top center of the combustion chamber.

Continuing with the combustion process, the rotor blades are forced to turn as the isolated volume expands. Eventually the rotor blades are no longer in contact with one another and the trapped volume of combusted gas is allowed to escape into the remainder of the combustion chamber. At this time the exhaust port is opened to allow the gasses inside the combustion chamber to escape. A vacuum may optionally pull these gasses out of the combustion chamber. The cycle then begins again.

It is the nature of this set of four rotors to revolve in a phased co-rotation at equal angular velocities provided by a beveled planetary gear set in which a range of reduction ratios may suit such purposes of the engine.

Intake and exhaust channels run through the (central) bores of the rotors and lead to ports on the sides of the rotors near the end of the 180 degree tip, with intake ports on the following side, exhaust ports on the leading side. In this configuration, the requisite porting channels are confined to the rotors only, leaving normal plenums effecting engine casing design.

The rotors are set on splayed axes, a configuration that expresses the invention of this design. Splay angles lead to a reporting of the rotor profile without effectively compromising the application of the four-cycle internal combustion process to this mechanism. Some of the advantages of containing a four-cycle internal combustion process in a rotary engine: fewer parts, smoother work cycle, higher power for size ratio, and a complete four-cycle process in one revolution of the rotors.

In addition, the offsetting of the rotor from the shaft (eccentricity) exposes a leveraging area on the face of the rotors that increases as the combustion progresses thereby increasing the available torque. The 'eccentricity' also effects the duration that the rotors remain in sliding (abutted) contact. There is a period of about 90 degrees, from 135 degrees to 225 degrees, in which a slight and gradual separation of the rotors occur (this compares to the overlap period in reciprocating piston engines). This separation is a function that follows as a result of splaying the axes but is of no consequence to the performance of the engine; the advantage of the 'overlap' in the reciprocating piston, internal combustion engine is not so viable in this design due to the nature of the rotor porting in this engine. If necessary, overlap is an option if the ports are arranged to sweep across each other. As it turns out, the period of slight separation of the rotors is of little consequence or little advantage and is a result of eccentricity.

The four semi-circular peripheral rotor pockets (volume between the rotors and the engine casing) work to our advantage. They are washed/fed by the intake rotor ports and create a volume for cooling as the rotors turn. During certain angles of rotation, some of the cooler gases are forced into the rotor exhaust ports diluting the exhaust and possibly providing oxygen for 'after-burn'. In general, these swept volumes have no direct effect on the four-cycle process. Due to the shape of the rotors and the casing, the rotors freely clear the pockets (i.e., no sliding contact). The term Pocket Volume is used to describe the areas around the rotors throughout the cycle. It is not to be confused with the combustion chamber.

Based on the following diagrams, the basic cycles of the embodiment are described in roughly 15-degree increments.

Zero degrees (FIG. 9)—Engine is at TDC. fuel/air mixture is already in the central chamber and under pressure waiting for spark to ignite. Exhaust gasses from previous cycle are in the surrounding pocket volumes being ported through the leading edge of the rotor and out through the pinion shaft where it is exhausted from the engine. Throughout the expansion power cycle, pocket vapor (air) is driven into the exhaust ports at tips of rotors (approximately through 90 degrees of rotation). Pocket volume is at a maximum and combustion chamber volume at minimum. Maximum rotor surface exposed to pocket vapor.

Approximately 90 degrees (FIG. 10)—Exhaust ports are opening to the combustion chamber; exhaust cycle extends under rotor contact effectively to 150 degrees with another 30 degrees to "B.D.C.".

Figure 11:
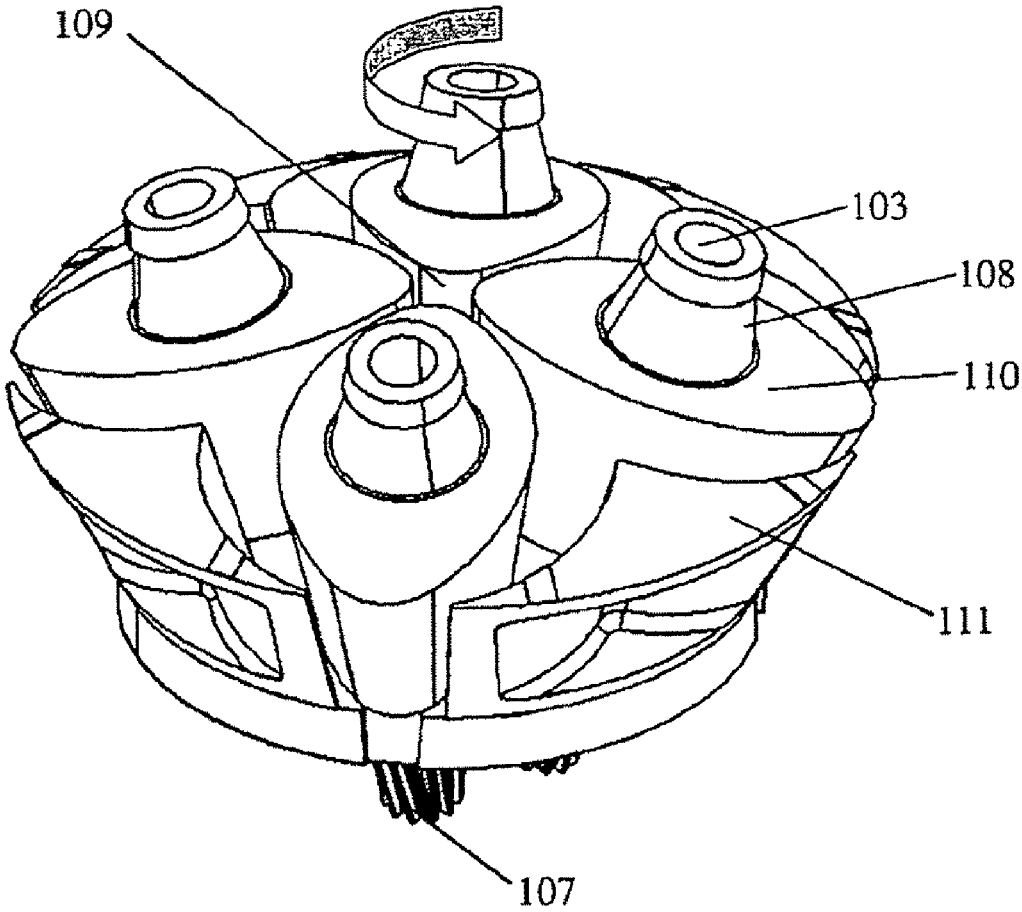
FIG. 11 is a perspective view of a basic cycles—135 to 180 degrees.
Figure 12:
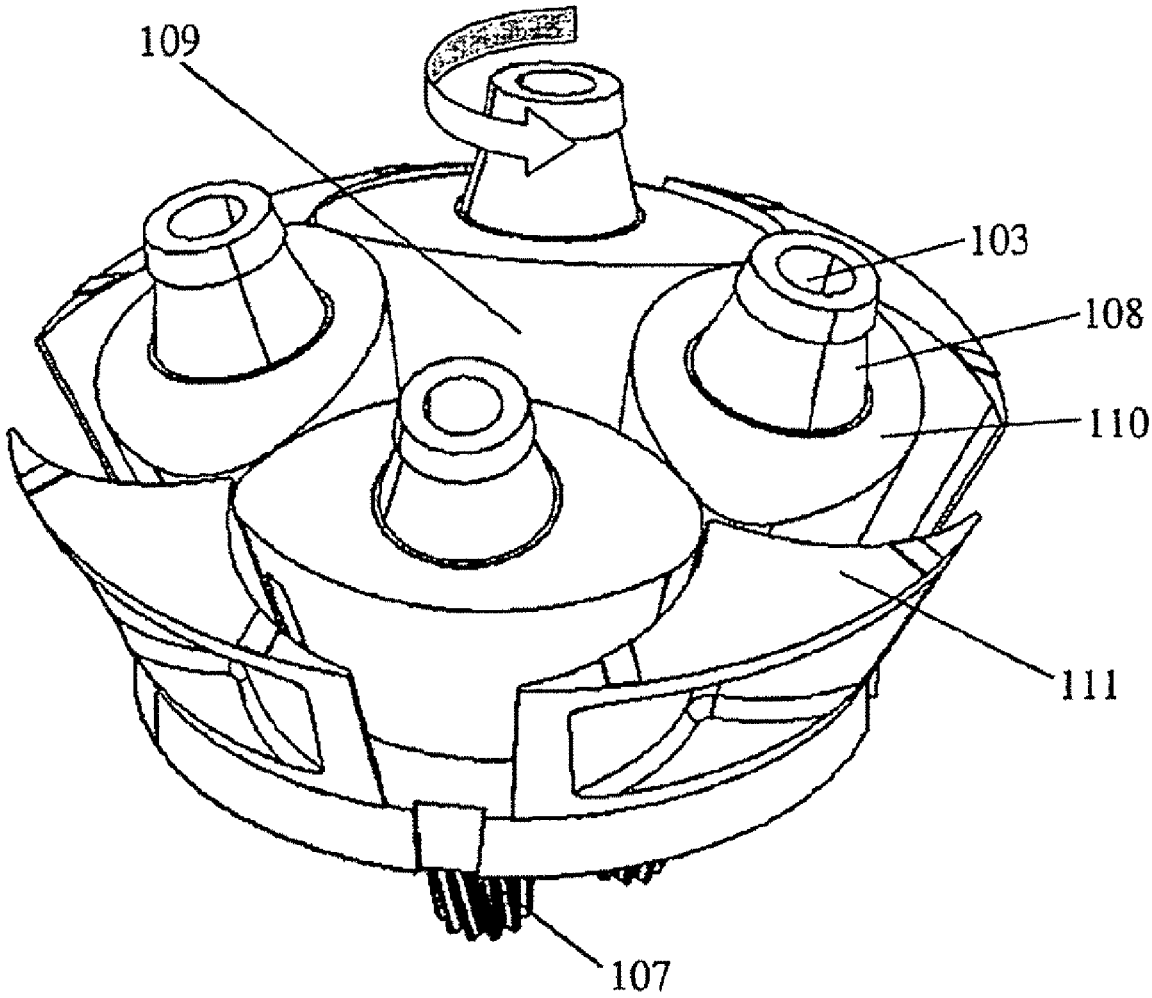
FIG. 12 is a perspective view of a basic cycles—190 to 270 degrees.
Figure 13:
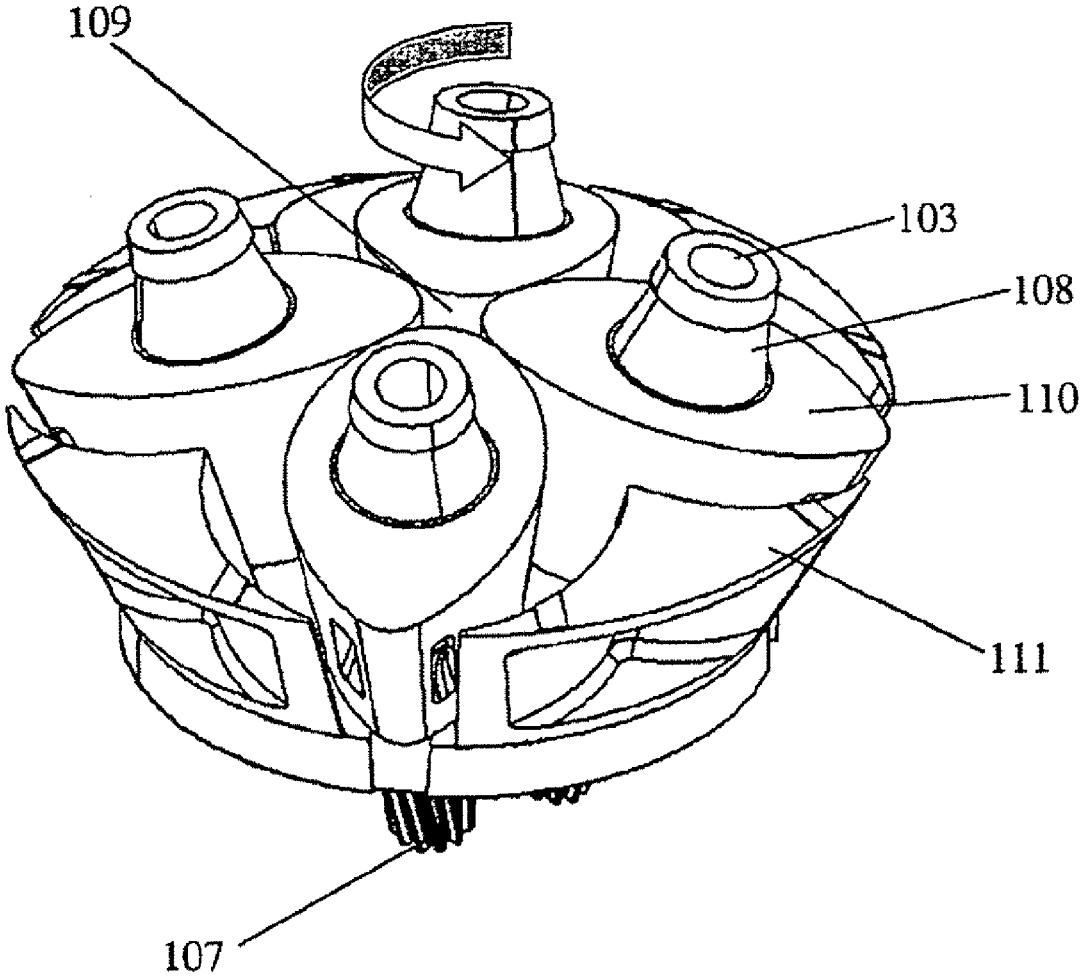
FIG. 13 is a perspective view of a basic cycles—360 degrees.
Figure 14:
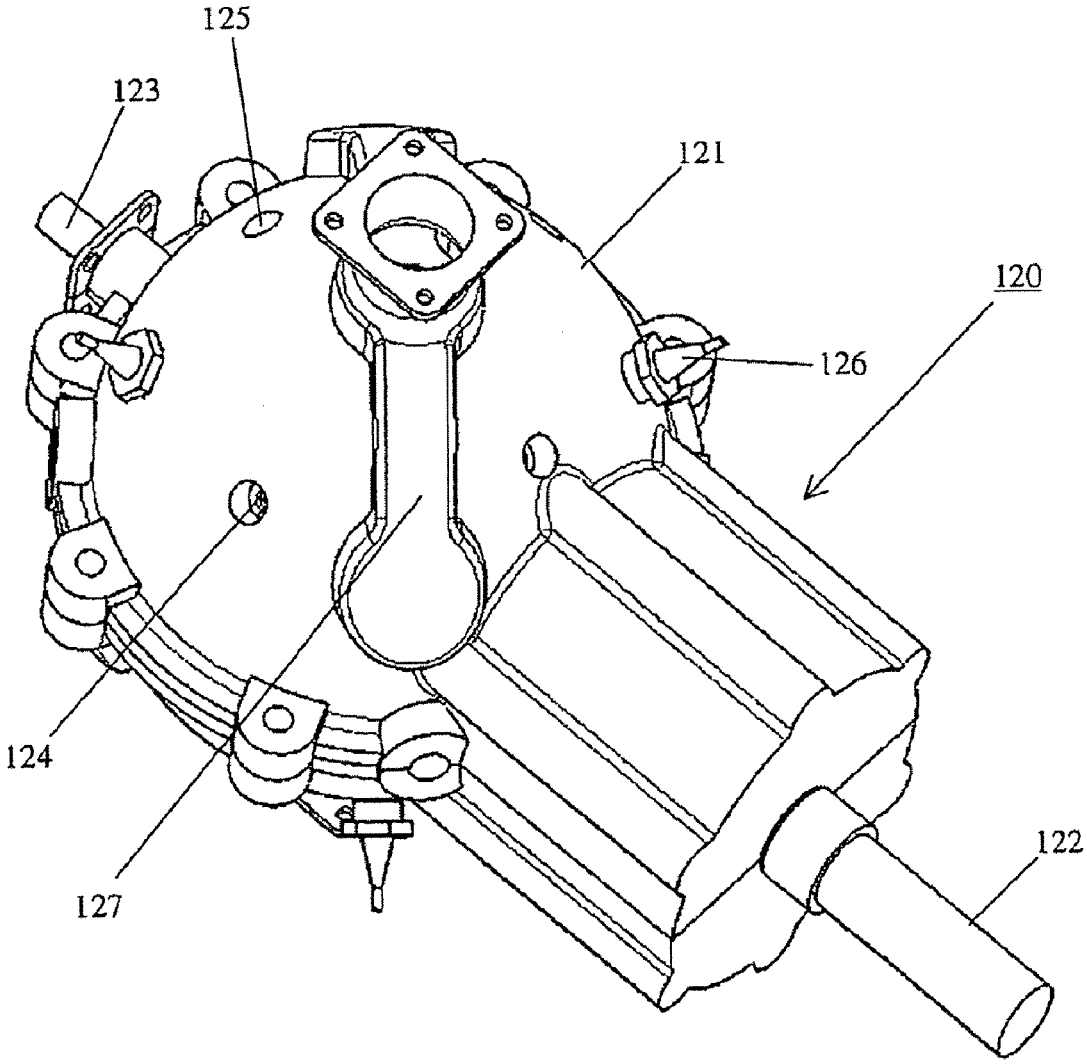
FIG. 14 is a perspective view of a two cycle, six rotor engine embodiment (top view)

135 degrees to 180 degrees (FIG. 11)—Rotors gradually separate after 180 degrees—Ports are in alignment for overlap. Overlap may extend as much as 20 degrees. In FIG. 11 the rotor blades are shown in a portion of their rotation where no contact between the blades exists.

Approximately 190 degrees (FIG. 12)—Intake ports open into central cavity. Exhaust ports open into pocket volume. Initial contact between the blades is made. During this portion of the rotation a volume inside the machine is isolated. As the blades continue to rotate the isolated volume decreases until a minimum volume is reached.

190 degrees to 270 degrees—Intake cycle. Exhaust ports are charged with pocket air.

Approximately 275 degrees—Compression cycle begins. Exhaust ports are 'buffered' by pocket air, hot side of rotors are cooled in pocket air, and Intake ports are charging pocket volume 360 degrees (FIG. 13)—After the point of minimum volume is reached, further rotation results with isolated volume expanding in size. Ignition occurs depending on timing advance.

The power stroke (cycle) lasts approximately 75 degrees.

At the 135 position, in which rotors are 'square' to each other, the point of tangency between the upper face of the rotor side and the short end tip radius begins to separate. The short rotor end tip radius can remain in tangency until this position due to the declining curvature of the true arc of the rotor side profile because of the eccentricity expressed at the 15° splay.

The 'overlap' end profile appears to be a ≈90 degree arc but is in fact two ≈45 degree splines symmetrical about the major axis of the rotor—the two splines meant to remain in contact (tangency) to (with) the 'upper' rotor sides. This leaves compression and expansion strokes in rubbing contact for 135 degrees, and effective closure for approximately 165°.

At 225 degrees is where the tip radius on the end of the rotor begins tangency with adjacent upper rotor side at the end of the overlap.

Another porting method involves the use of opposing pairs of head ports; one pair for exhaust and the other for intake. This is not a preferable porting method, but still works.

Six-Rotor Spherical Engine

FIGS. 14 through 25 illustrate a six-rotor spherical engine utilizing a two-stroke combustion cycle. Although the pictured embodiment is of an engine, the concepts and basic machine philosophies apply to a pump.

In FIGS. 14-25, a two cycle six rotor spherical rotary engine 120 has a casing 121 having a drive shaft 122 protruding from the casing at one end and an output shaft 123 protruding from the other end thereof. The engine has a pair of exhaust ports 124 and 125 on each side thereof along with spark plugs 126 and an intake manifold 127 on each side of the engine 120.

Figure 10:
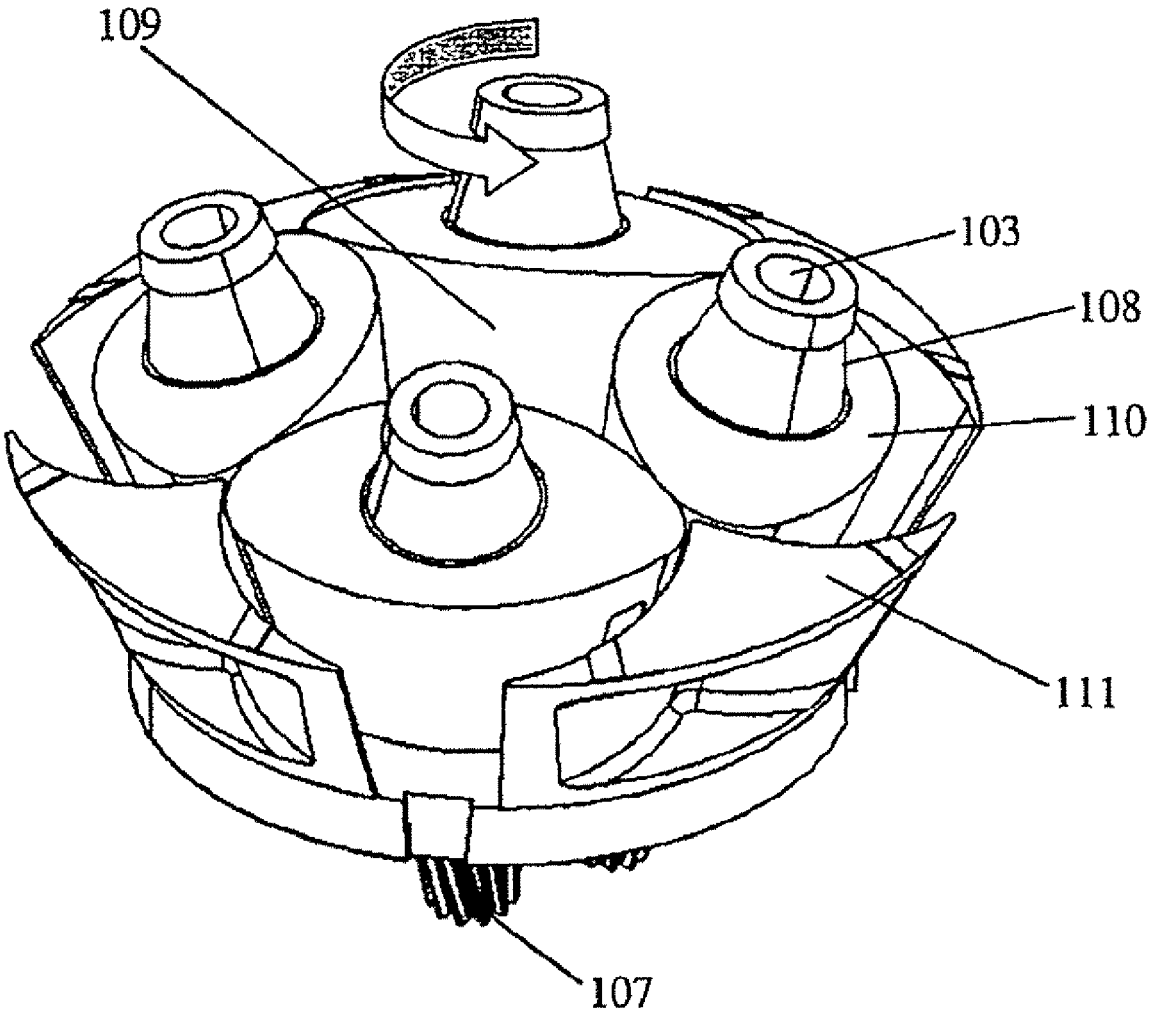
FIG. 10 is a perspective view of a basic cycles—90 degrees.
Figure 17:
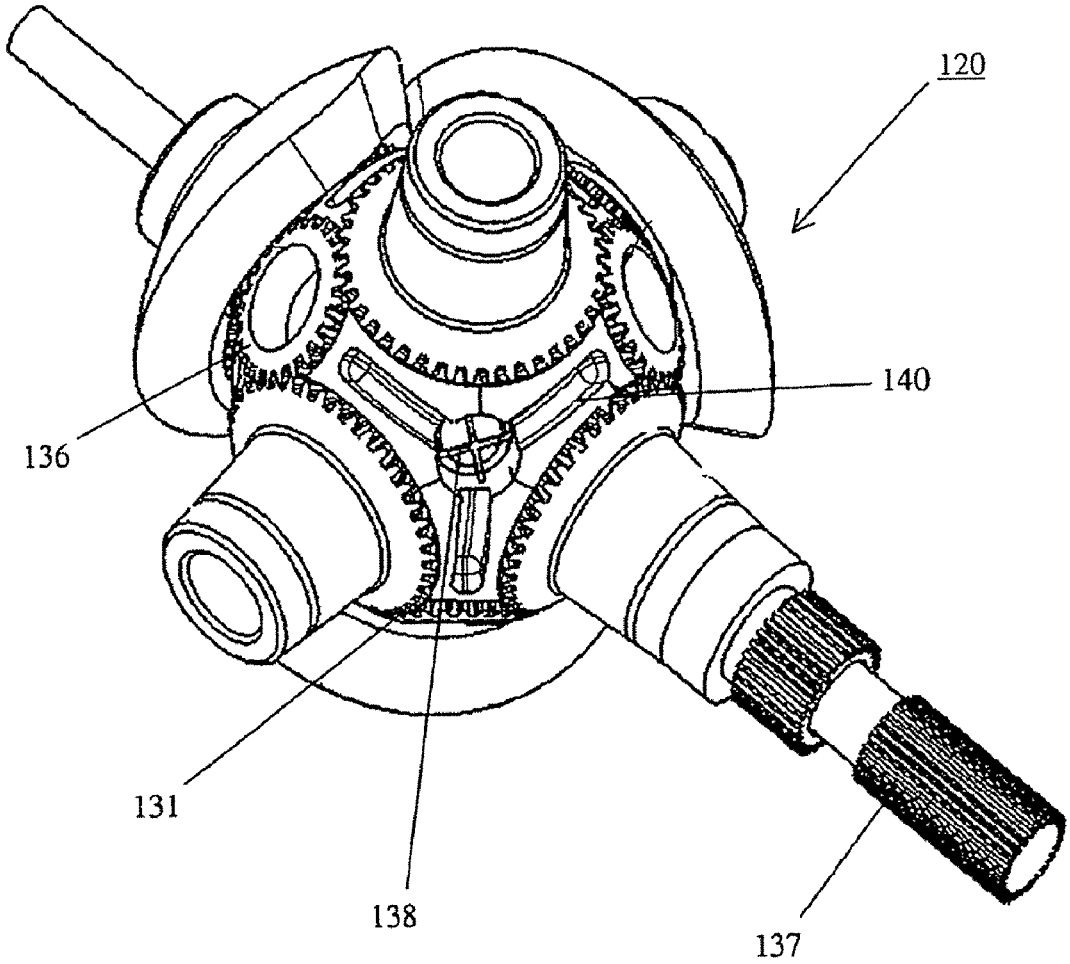
FIG. 17 is a perspective view of a two cycle, six rotor engine with rotors removed.
Figure 18:
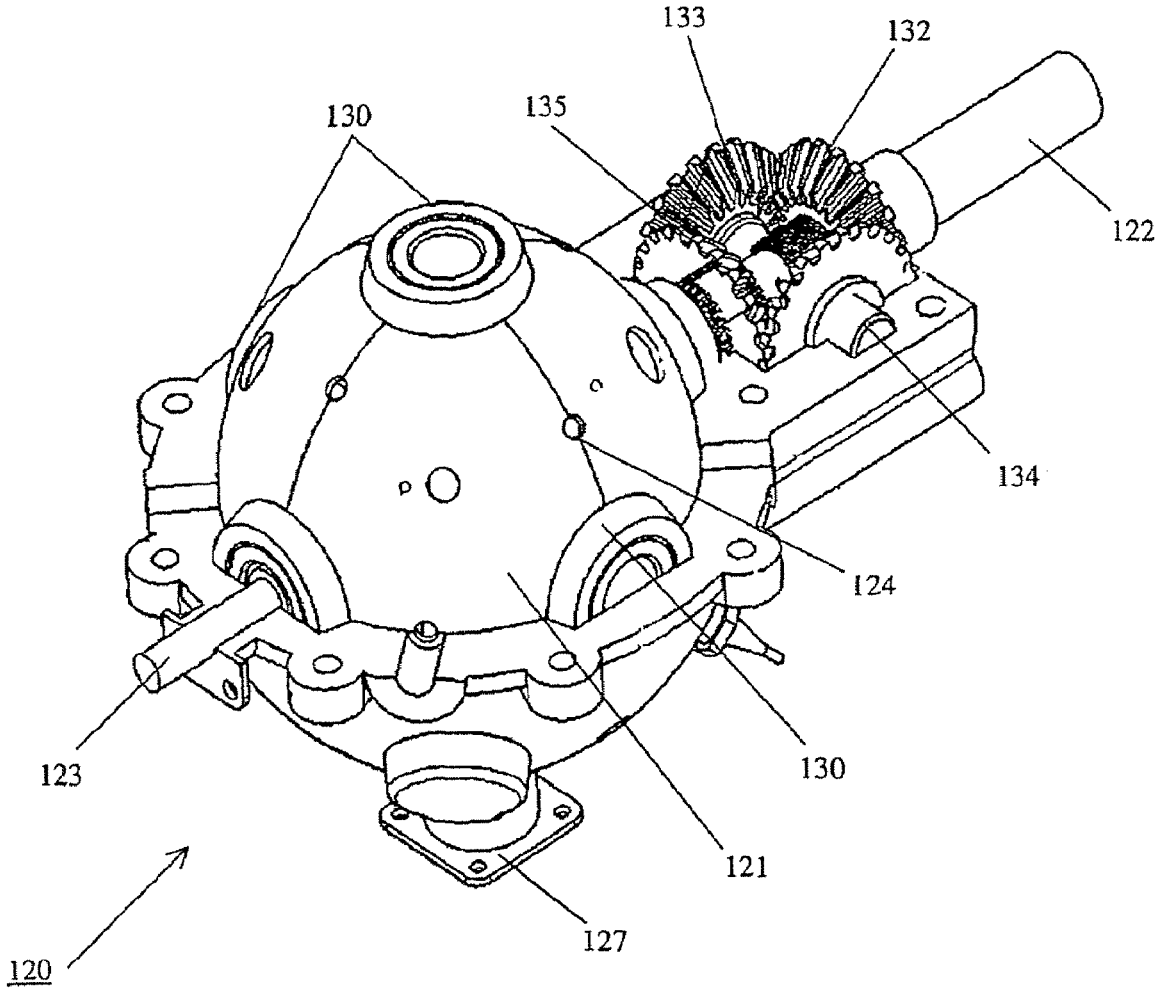
FIG. 18 is a perspective view of a two cycle, six rotor engine internal.
Figure 19:
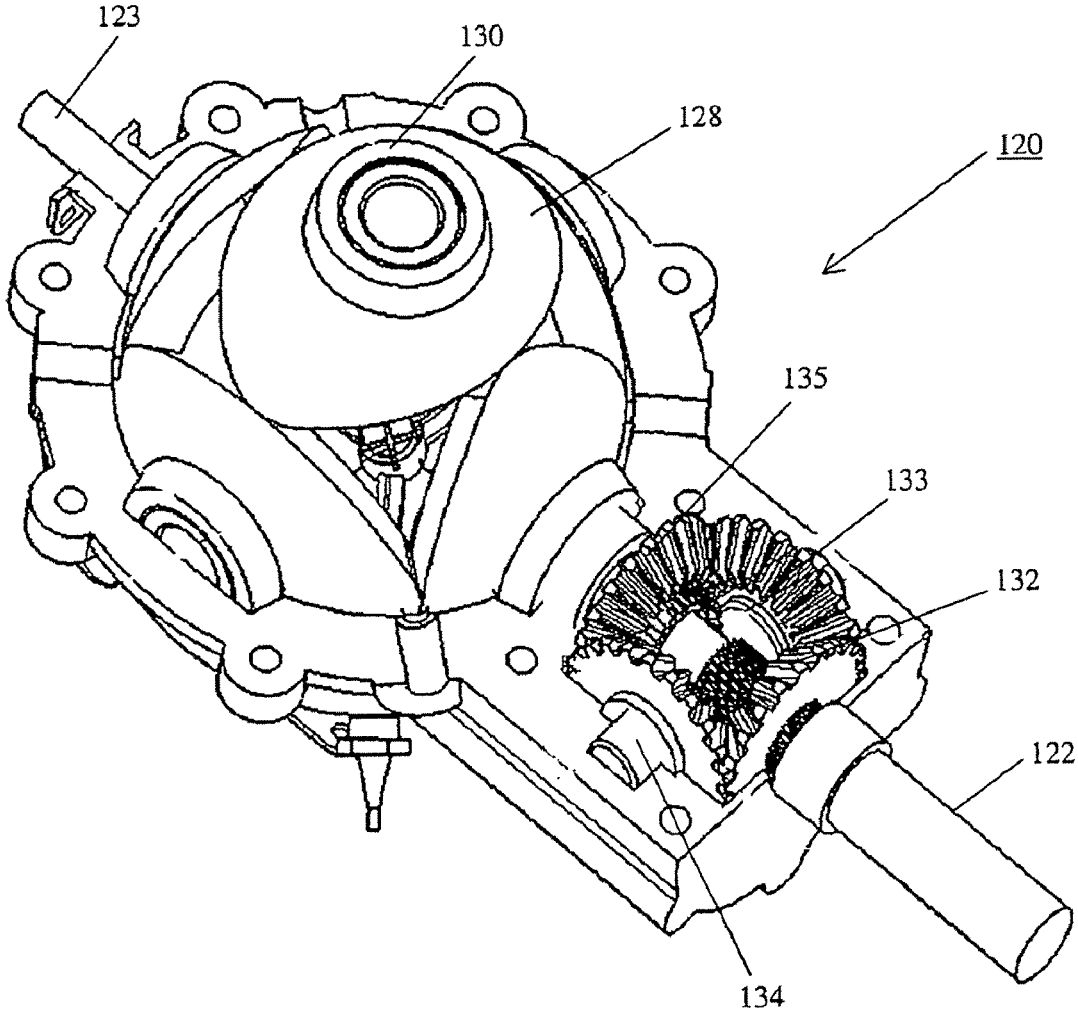
FIG. 19 is a perspective view of a two cycle, six rotor engine internal casing covers removed.
Figure 21:
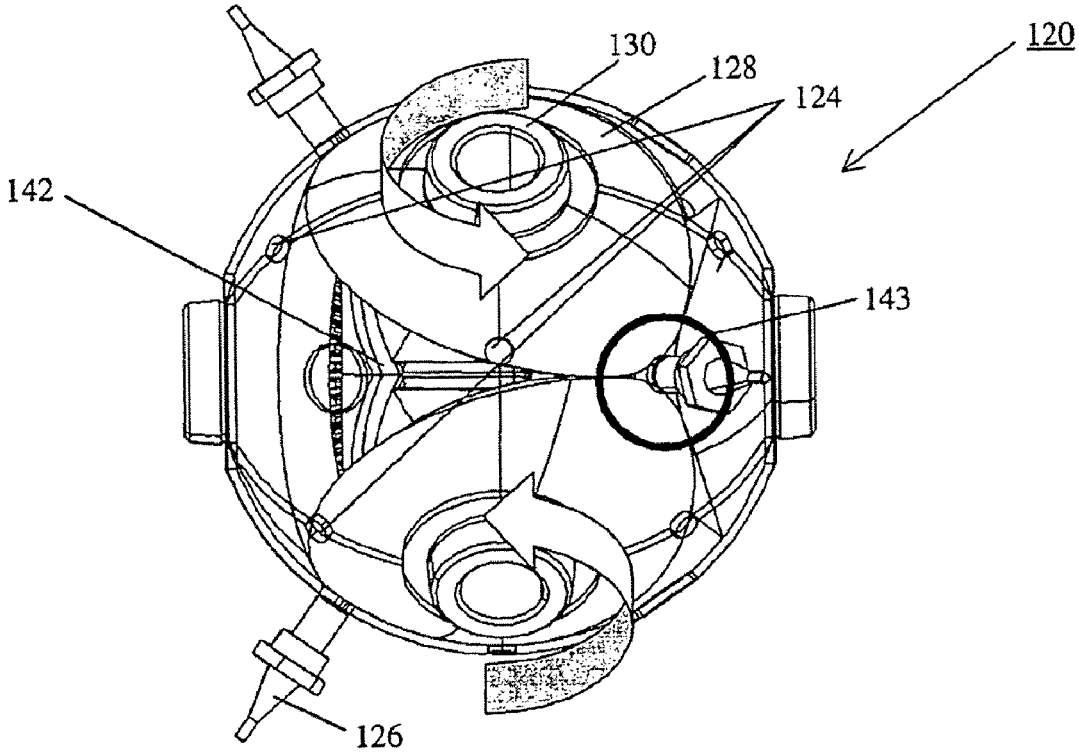
FIG. 21 is a perspective view of the engine of FIG. 19 at top dead center.
Figure 22:
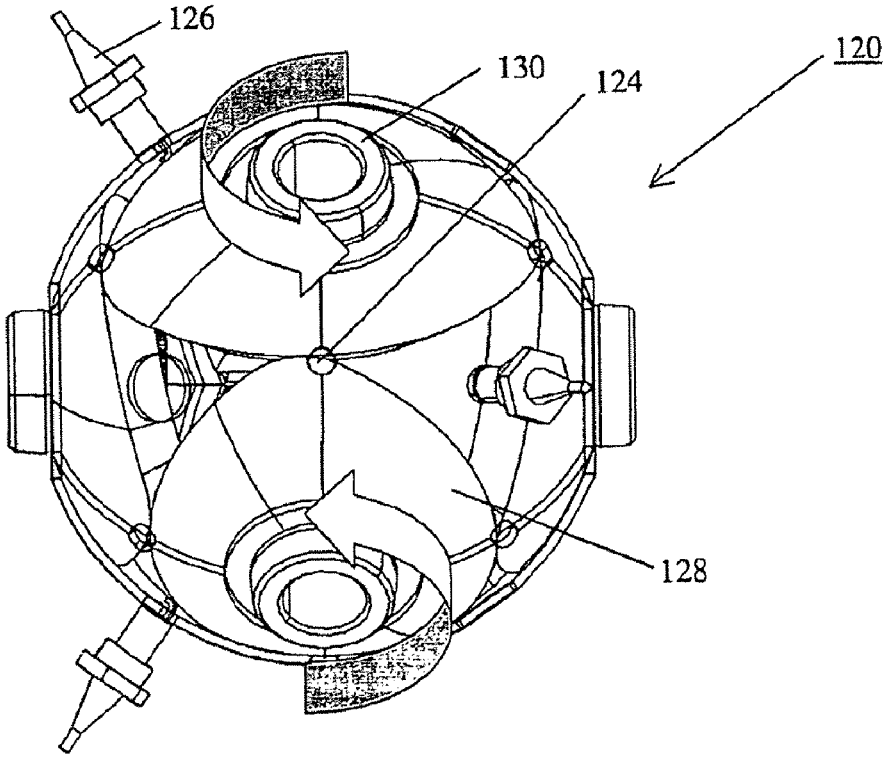
FIG. 22 is a perspective view of the engine of FIG. 19 at 100 degrees into expansion cycle.

As seen in FIGS. 16-19, the engine 120 has a plurality of rotors 128, each of a general teardrop shape with each rotor attached to a spindle extending from a gear 131. The drive shaft 122 is connected to a differential gear 132 which includes a pair of gears 133 each rotating on a differential pin 134 for meshing gear 132 through the gears 133 to engage the gear 135. In FIG. 17, a poppet check valve 138 can be seen along with a plurality of transfer ports 140. A hollow output shaft 137 is also shown in FIG. 10 which connects to the output shaft 122 through the differential gears. In FIGS. 21 and 22, the three exhaust ports 124 can be seen along with the firing chamber 143 and the transfer of grooves or ports 142. Precompression chambers 141 indicated in FIG. 20 along with the combustion chambers 140.

Figure 15:
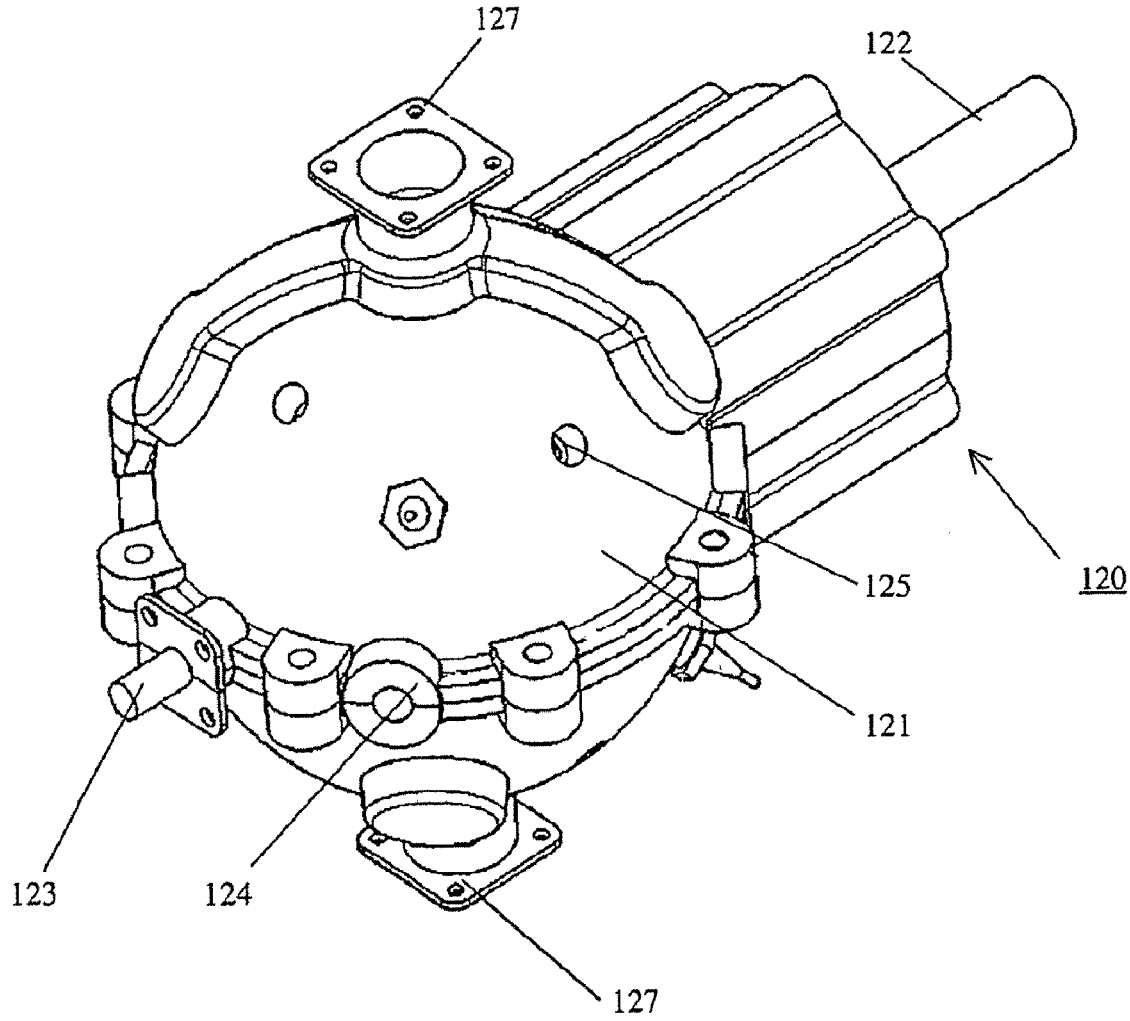
FIG. 15 is a perspective view of a two cycle, six rotor engine embodiment (front view)
Figure 16:
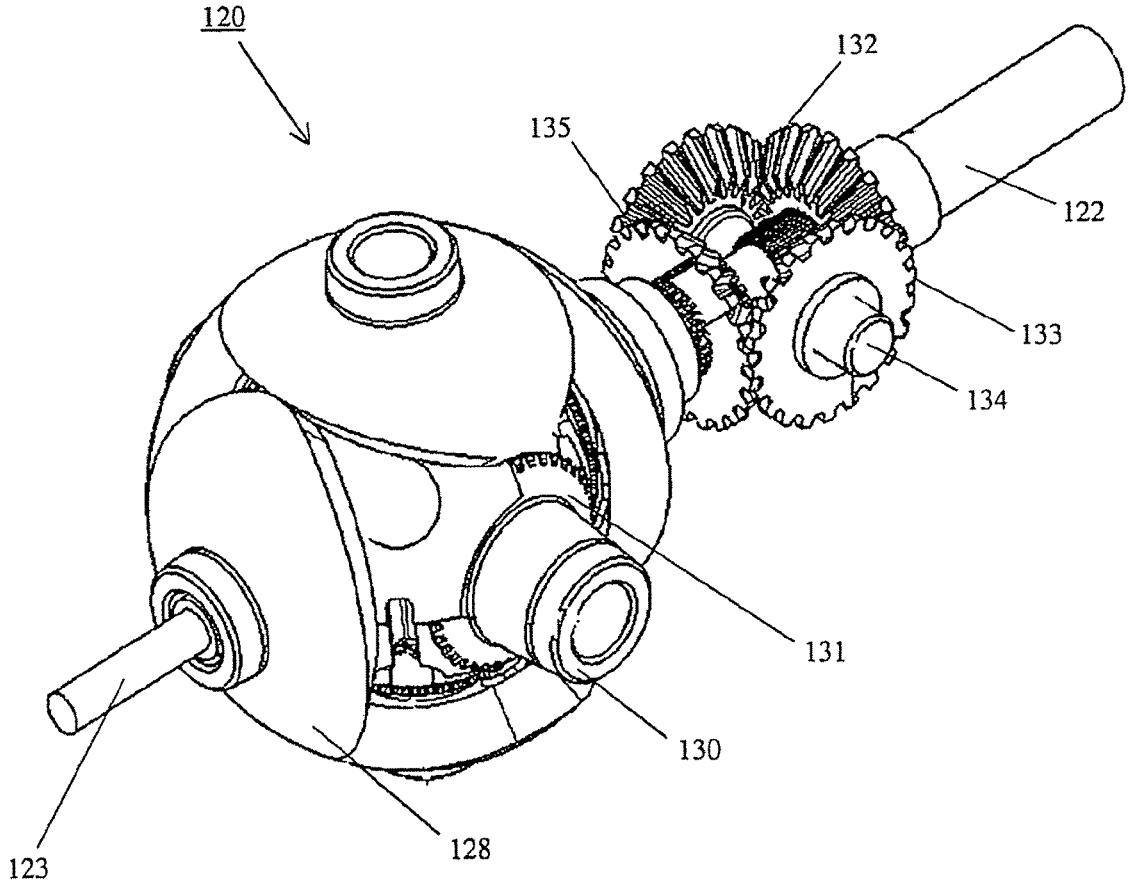
FIG. 16 is a perspective view of a two cycle, six rotor engine with casing removed.

Referring to FIGS. 14 through 25, six identical, bi-polar rotors 128 cooperate in spherical order creating eight cavities at the apexes of a contained theoretical cube. Operating pressures are exerted evenly on both ends of the rotor with all six rotors co-rotating in the same angular direction and at the same angular velocity. Input design parameters include the radius of the operating sphere, thickness of rotors, and the tip radius of the rotors 128. Relative movement between the rotors is a tangential sliding contact as they move against each other. The embodiment shows a planetary gear set used to transfer torque evenly and to help synchronize the machine. This gear set can be internal as shown in FIG. 15 or mounted externally to the rotors as required.

The fuel/air mixture is fed into four of the eight chambers due to low pressures generated by rotor movement. These four chamber act as intake and pre-compression chambers. Check valves are used to control the direction of the fuel/air mixture flow. During this intake cycle, the alternate four chambers are in their working cycle of firing and combustion. As the rotors 128 continue to rotate, the fuel/air mixture then passes from the pre-compression chambers into the adjacent chamber via transport channels that become open or "exposed" as the rotors pass over inlet ports. This is phased to coincide with the compression and firing of the adjacent chambers. The cycle then repeats itself in an alternating sequence creating the two cycles of the engine.

Figure 20:
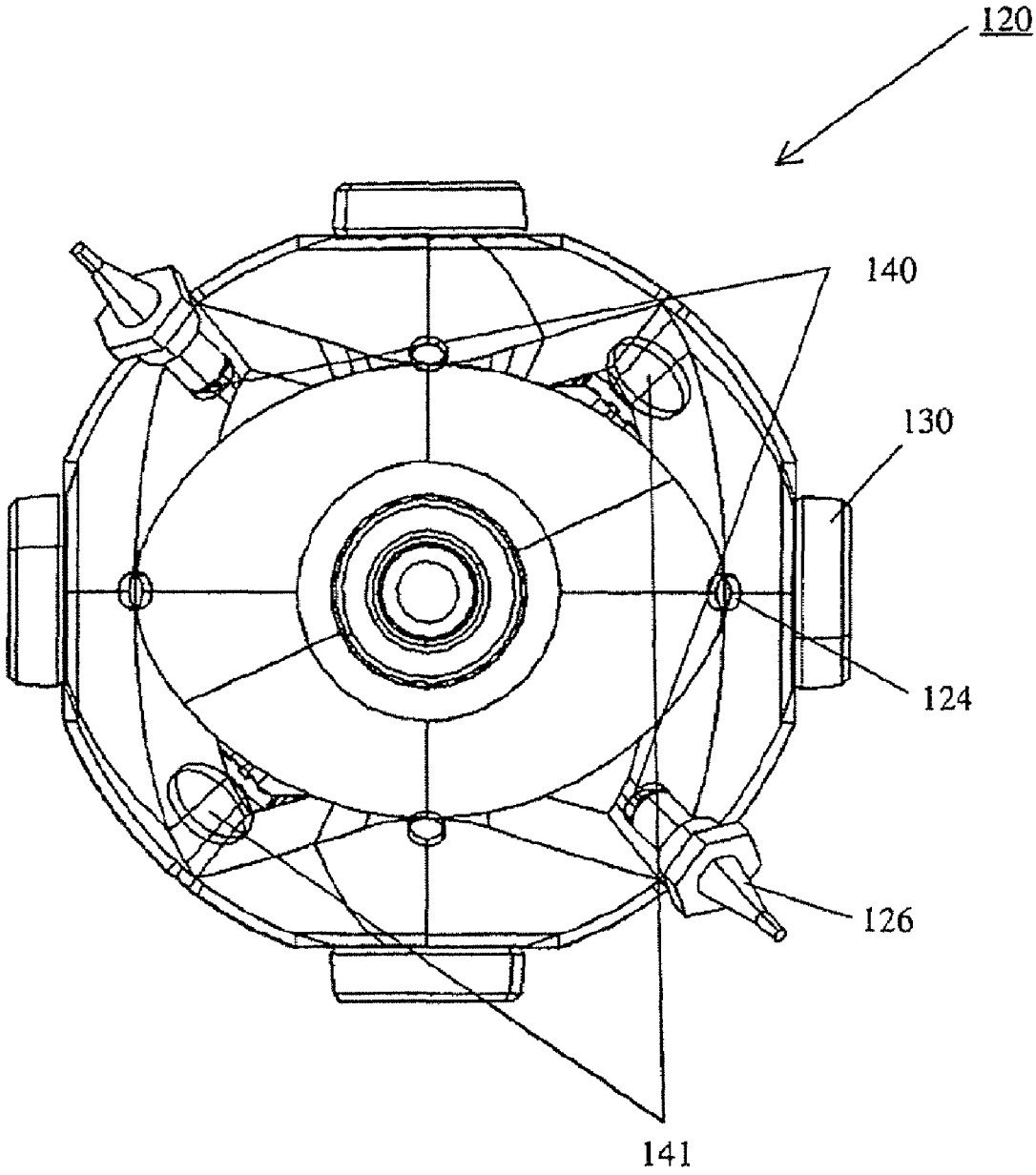
FIG. 20 is a top elevation looking down a rotor axis. Each semisphere or half of the engine contains four chambers. Two are used for power extraction and the other two are used to ready the fuel/air mixture for intake into the two adjacent firing chambers. (These two chambers are equivalent to the use of the crankcase in a conventional, reciprocating, 2-stroke engine)

FIG. 20 shows a view looking down a rotor axis. Each semi-sphere, or half of the engine, contains four chambers.

Two are used for power extraction and the other two are used to ready the Fuel/Air mixture for intake into the two adjacent firing chambers. These two chambers are equivalent to the use of the crankcase in a conventional, reciprocating, two-stroke engine.

The operation of the two-cycle engine 120 is illustrated in FIG. 21 through 25. Each picture depicts a combustion chamber 120, and an adjacent pre-combustion chamber 141. The cycles being described are actually occurring simultaneously in the four other chambers per engine cycle. At the current position shown, the rotors 128 are at TDC. The firing chamber 143 (right side) is at its smallest size and the pre combustion chamber is at a maximum.

The spark plug 126 fires and the rotors 128 are turned due to expansion of the gases. The rotor 128 is at approximately 100 degrees in its expansion cycle in FIG. 22. Conversely, in the adjacent chamber 140, the pre combustion mixture that was introduced into the chamber through one-way check valves from the intake manifold on the engine case 121 is being compressed. At approximately 100 degrees, the exhaust port 124 is exposed allowing venting through the engine case 121.

Figure 23:
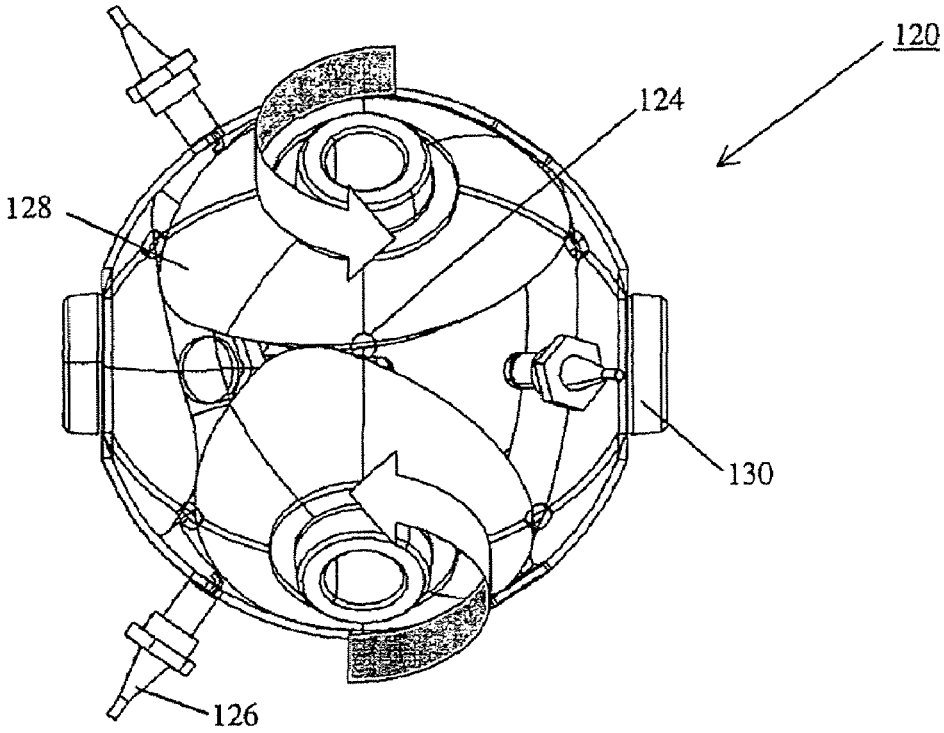
FIG. 23 is a perspective view of the engine of FIG. 19 at 120 degrees, exhaust is vented and intake begins.
Figure 24:
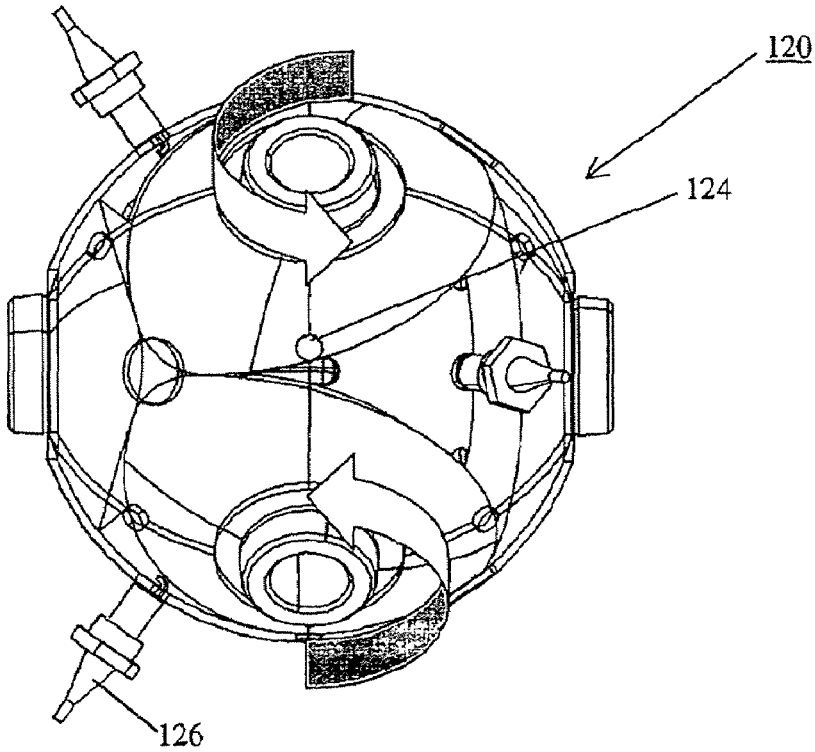
FIG. 24 is a perspective view of the engine of FIG. 19 at 180 degrees, exhaust port is closed, intake pre-compression is ending, combustion chamber compression begins.
Figure 25:
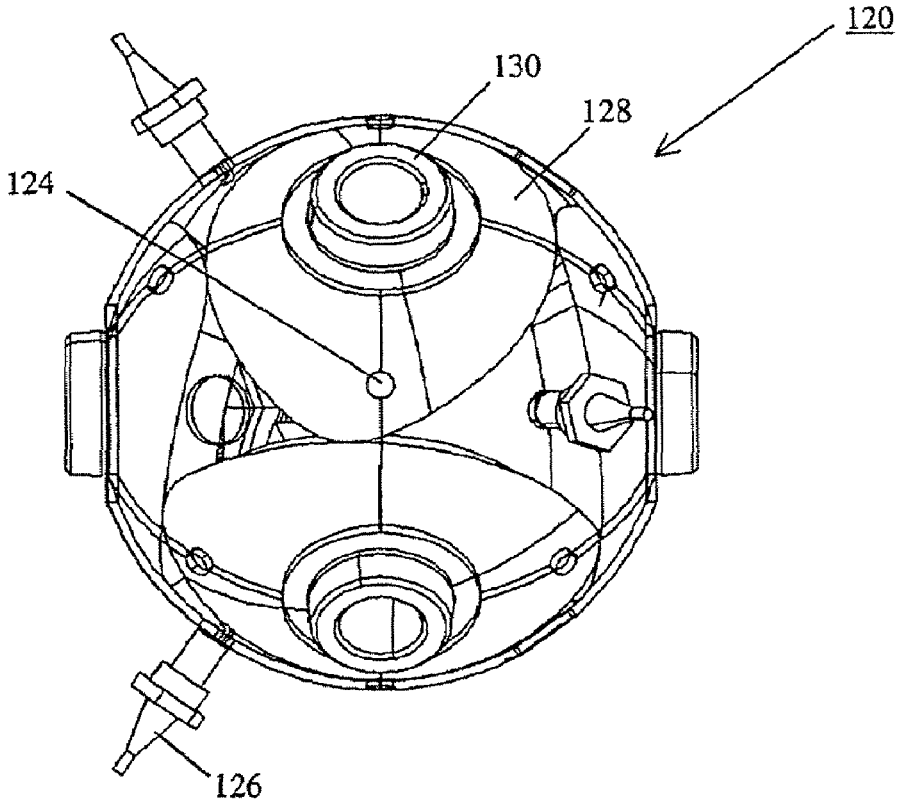
FIG. 25 is a perspective view of the engine of FIG. 19 at 230 degrees, all ports are closed, combustion chamber is compressing.
Figure 26:
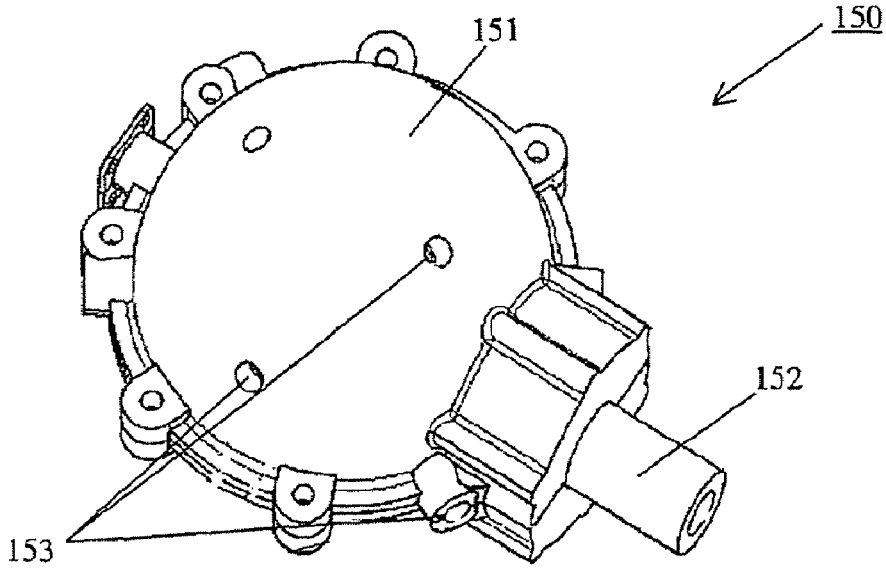
FIG. 26 is a perspective view of the externally powered embodiment of the engine.

At approximately 120 degrees FIG. 23, the exhaust gasses are mostly vented and the transfer port opening is exposed from underneath the rotor 128. This allows the compressed, precombustion mixture to transfer through the transfer grooves into the combustion chamber 140. This creates the "overlap" period between exhaust and intake common in two-stroke cycles. Moving or changing the sizes of the various ports, the flow characteristics of the exhaust and import can alter gasses for peak efficiency and lowest emissions.

At 180 degrees (FIG. 24), the rotor 128 has compressed fully the precombustion chamber 141 and is now starting to compress the combustion chamber 140. The transfer port 142 is fully exposed and the exhaust port has now been closed (covered) due to the path of the rotor 128.

At approximately 230 degrees (FIG. 25), the rotor 128 has covered both the exhaust port 124 and the transfer port 142 and the compression cycle of the fuel mixture begins. As the combustion chamber 140 is compressing, the pre combustion chamber 141 is pulling in a new fuel mixture through the one-way check valve to repeat the process.

FIGS. 26 through 36 show an alternative version of a six-rotor spherical engine 150. This embodiment depicts an engine 150 that can run on steam or compressed gases.

Figure 27:
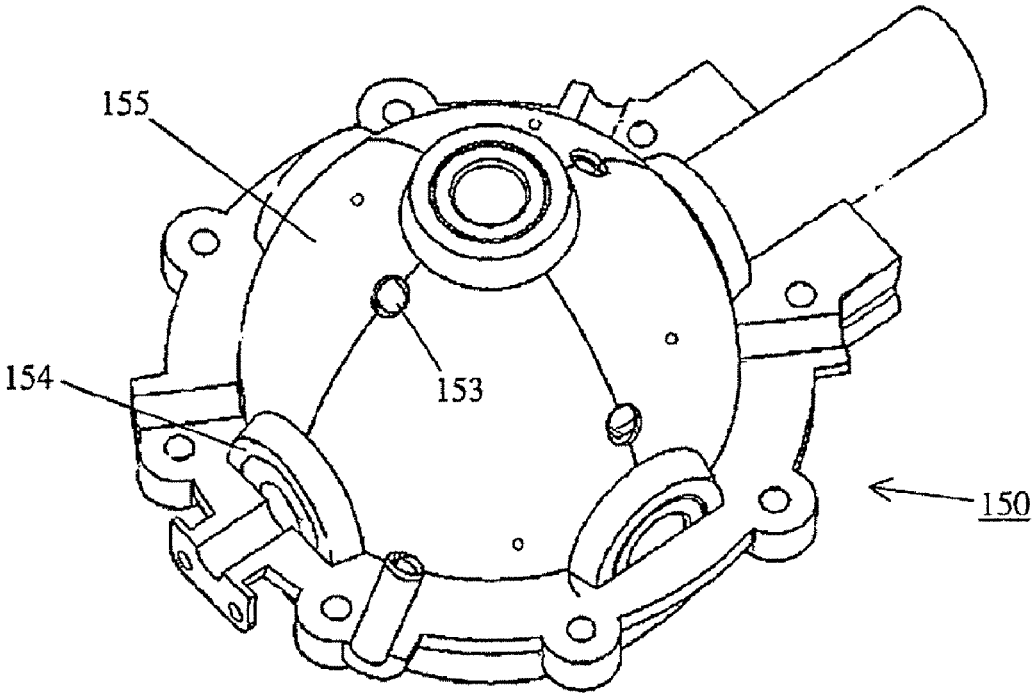
FIG. 27 is a perspective view of the externally powered engine having the top half of casing removed.
Figure 28:
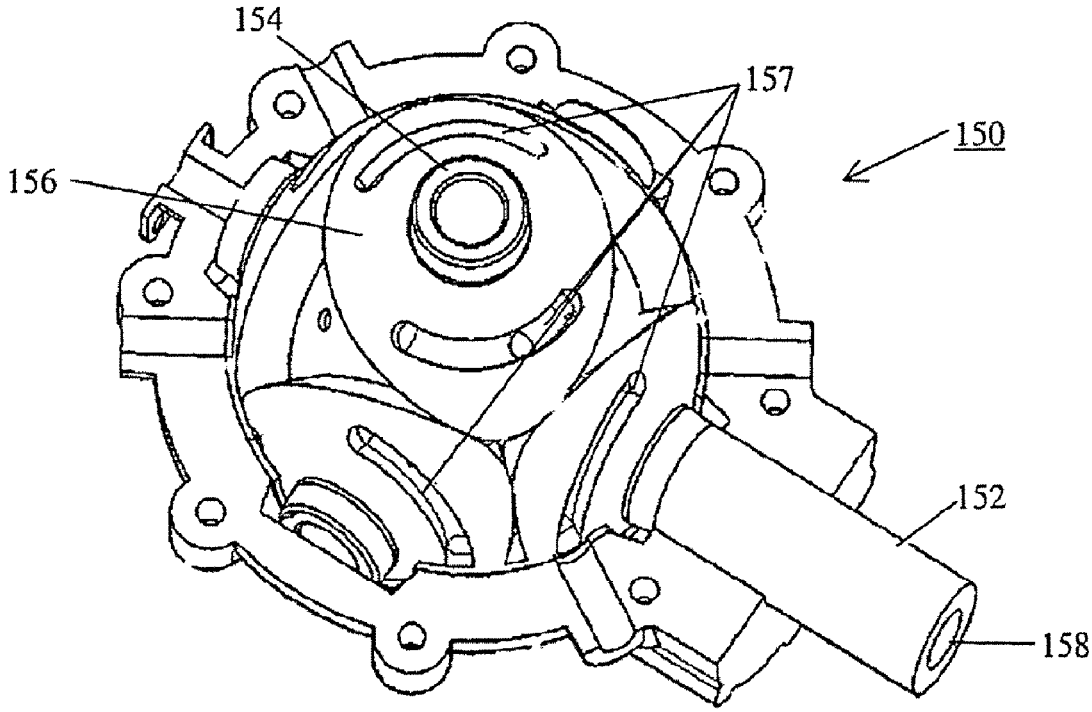
FIG. 28 is a perspective view of the externally powered engine having the internal casing removed.
Figure 29:
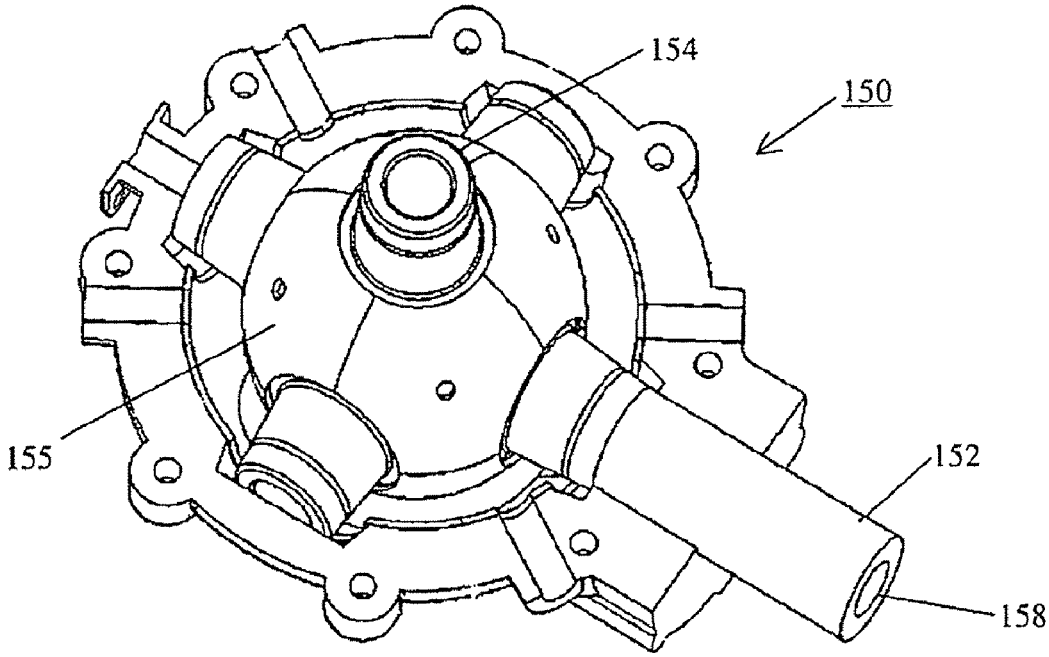
FIG. 29 is a perspective view of the externally powered engine having the rotors removed.
Figure 30:
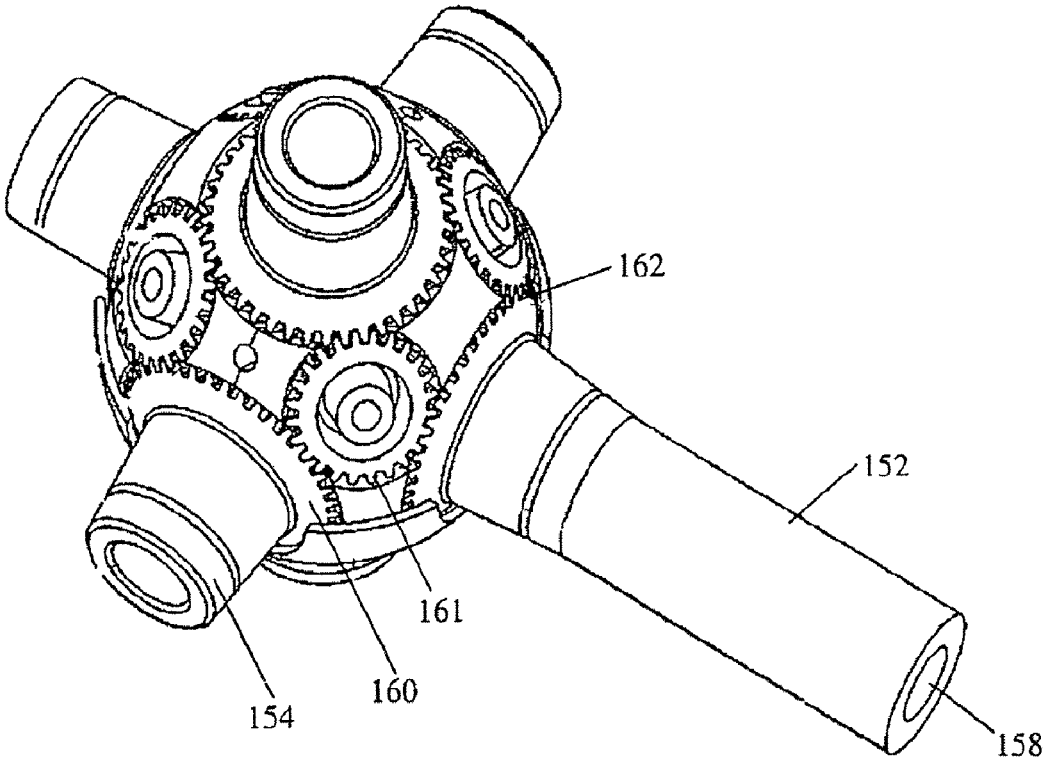
FIG. 30 is a perspective view of the externally powered engine having the rotors and internal casing removed.
Figure 31:
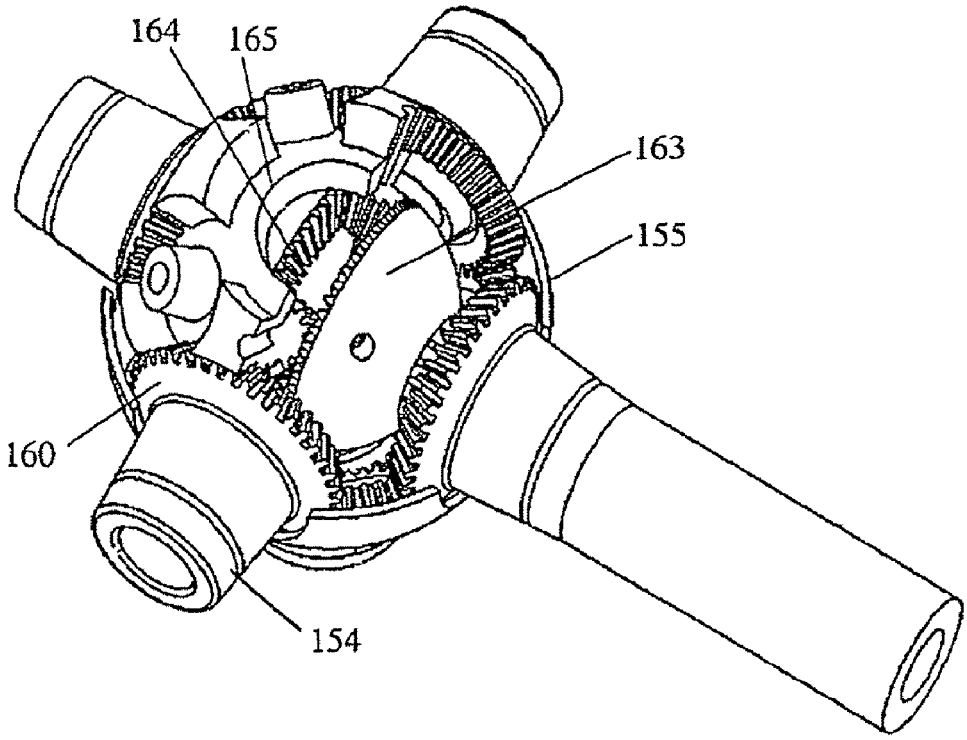
FIG. 31 is a perspective view of the externally powered engine having the bearing hemisphere removed.
Figure 32:
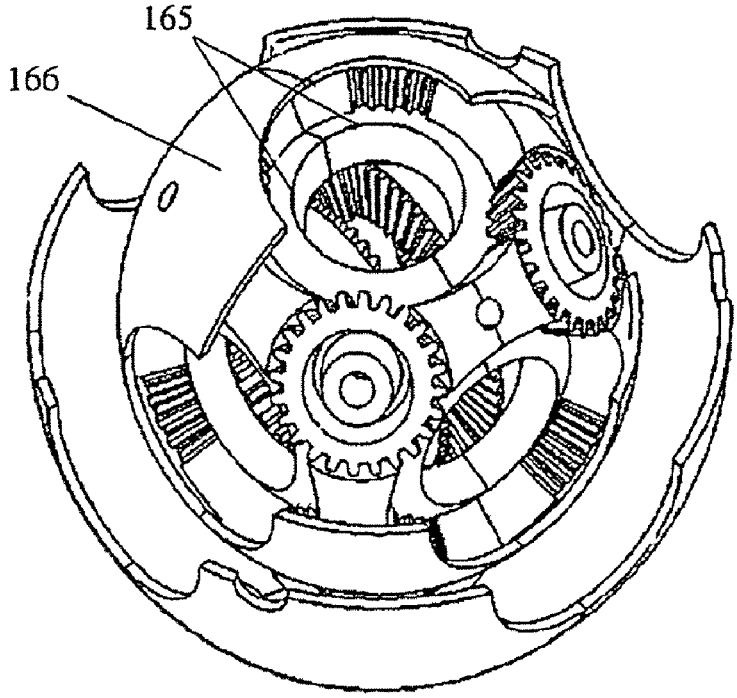
FIG. 32 is a perspective view of the externally powered engine having the internal gearing and casing.

In FIGS. 26-36, the external power six rotor rotary engine 150 has a casing 151 having an output gear 152 extending therefrom. Rotary bearings 154 extend from each side of the engine, as seen in FIG. 27, which also show the outer sectors 155 and the air exhaust 153 therethrough. A plurality of eccentrically mounted and generally tear shaped rotors 156 each has an exit air passage 157 from the compression chambers. The output gear 152 can be seen having the passageway 158 therein for pressurized air intake. Each rotor 156 is mounted to one of the rotary bearings 154 spindle portion which in turn is connected to the bearing 160, as seen in FIGS. 30-32, each gear 160 meshes with a idle gear 161 which in turn meshes with the output shaft gear 162 for driving the output shaft 152.

In FIG. 31, a rotary valve 163 can be seen along with sector 155. The rotary valve 163 is mounted inside a bearing hemisphere 164. A rotary valve 163 has gear teeth 164 and the sectors 165 are mounted inside the outer sectors 155 and rotors 156 to house the rotary valves 163 therein.

Figure 33:
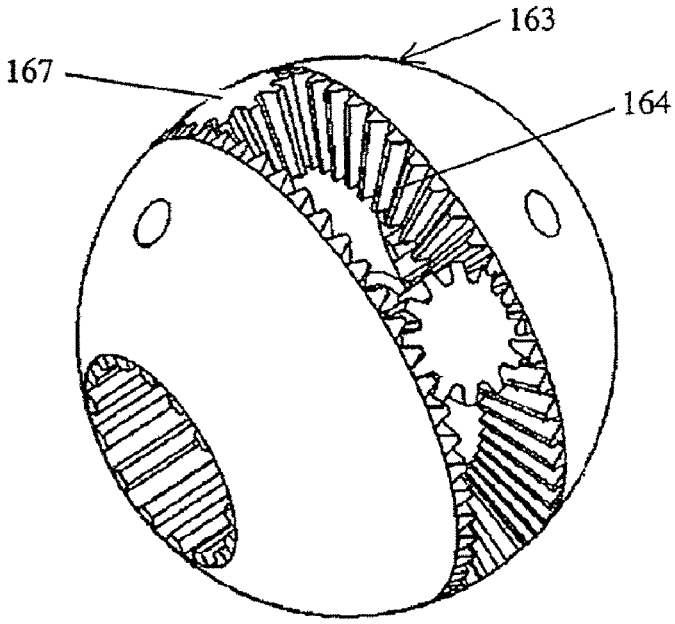
FIG. 33 is a perspective view of the externally powered engine differential gearing.
Figure 34:
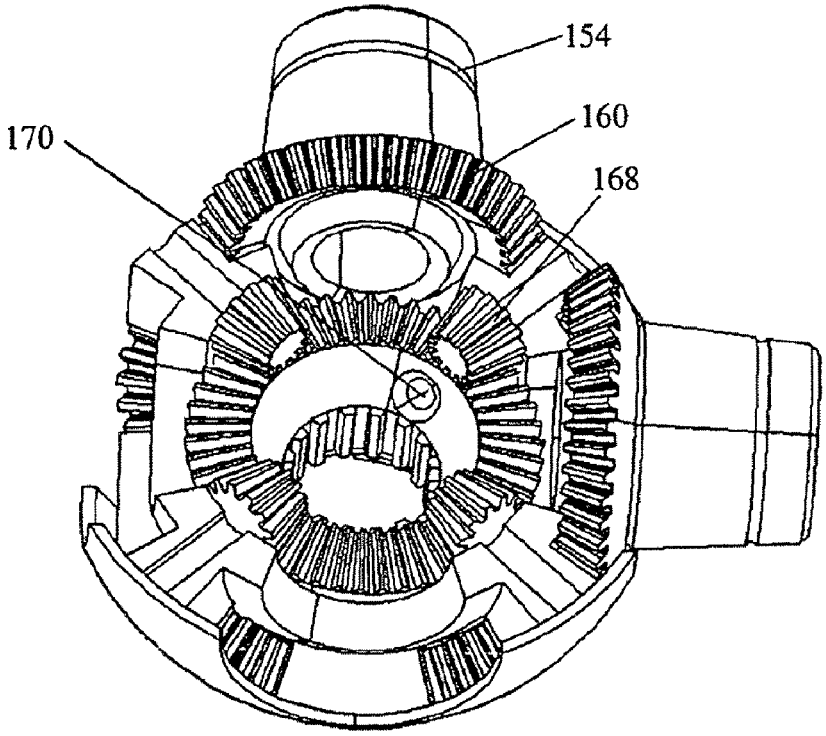
FIG. 34 is a perspective view of the engine gear train.
Figure 35:
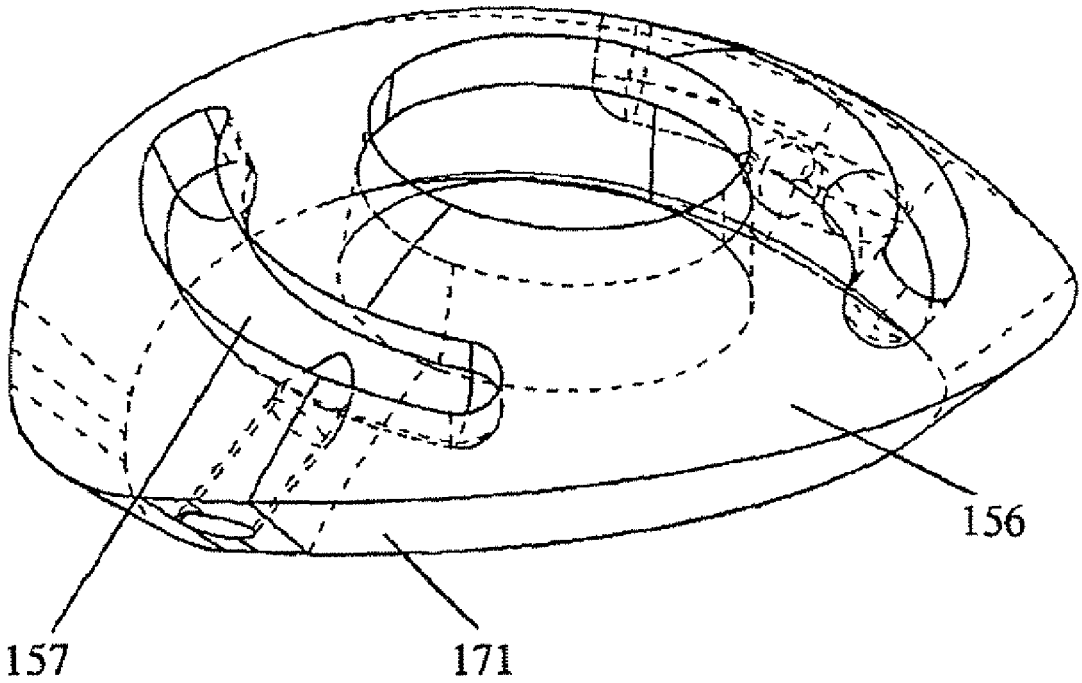
FIG. 35 is a perspective view of a close-up of the engine rotor.
Figure 36:
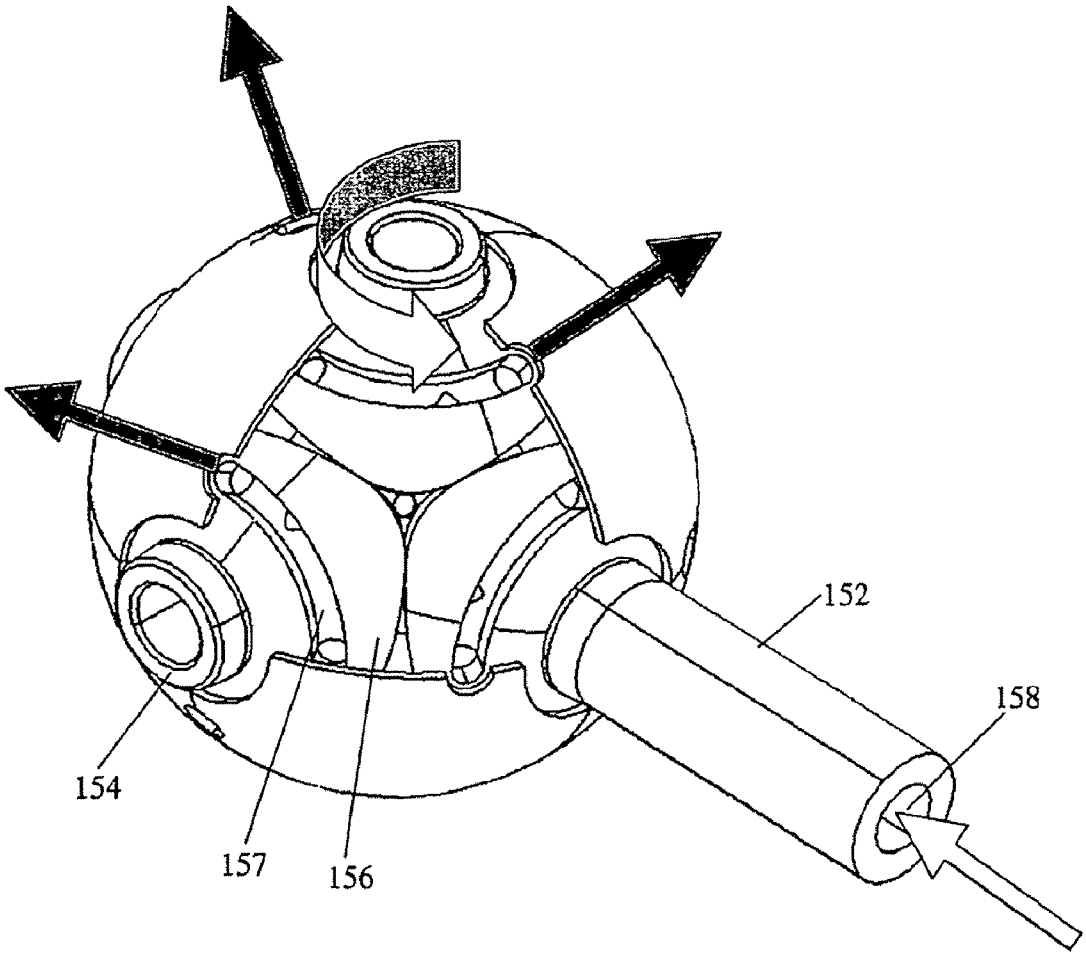
FIG. 36 is a perspective view of the engine intake and exhaust.

FIG. 33 more clearly shows the rotary valves 163 having the gear teeth 164 and having spider gears 167. In FIG. 34, the rotor shafts 154 are shown connected to the bevel gears 160 which raises the rotors 154 together for an even distribution of torque. Spider gears 168 act in a dual roll as a differential to evenly distribute torque from the rotors and to phase the rotary valves with the rotary ports while rotary ports 170 allow energy to enter the chamber as it rotates and aligns with corresponding inlet ports. In FIG. 35, a single rotor 156 is illustrated having a generally tear drop shape and an angled edge 171 for smoothly rolling against the edge 171 of a second adjacent rotor 156. The rotor has the exhaust ports 157 passing through the rotor.

Six identical, bi-polar rotors 156 cooperate in spherical order creating eight cavities. Operating pressures are exerted evenly on both ends of the rotor with all six rotors 156 co-rotating in the same angular direction and at the same angular velocity. Input design parameters include the radius of the operating sphere and the tip radius of the rotors 156. The embodiment shows a planetary gear set used to transfer torque evenly and to synchronize the machine. This gear set can be internal or mounted externally to the rotors 156 as required.

In operation, steam or compressed air is channeled into the center spherical chamber through the main rotor shafts 152. All porting, venting and intake is done by the opening (exposing) or closing (hiding) of ports by the rotation of internal parts as they rotate through 360 degrees. Rotating valves connected through a planetary gear set, phased with the rotation of the rotors, allow the "fuel" to pass into the rotor chambers to extract the work. Once the work has been done, the spent fuel is released through openings at the leading ends of the rotors and vented through channels 157 in the rotors 156. As the rotor 156 rotates, the channels 157 align with output vents 153 in the engine case 151. The internal rotary valve assembly 163 uses a set of transfer pinions 167 set between the beveled gears 164 on the rims of the rotary valves 163. The transfer pinions 167 allow for the direct transfer of torque from opposing rotors.

Five Rotor Pump

Figure 37:
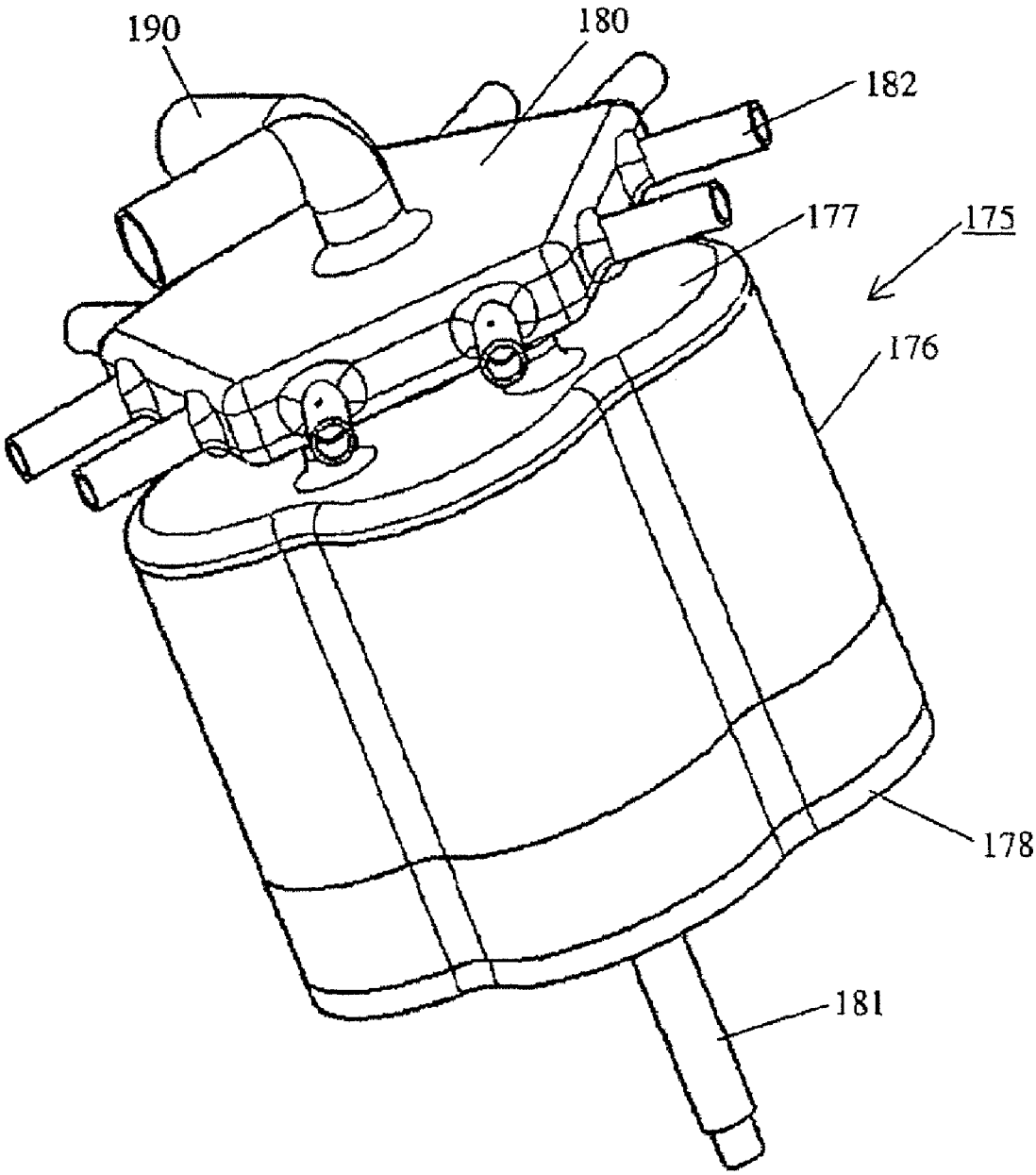
FIG. 37 is a perspective view of a five rotor parallel axis pump.
Figure 38A:
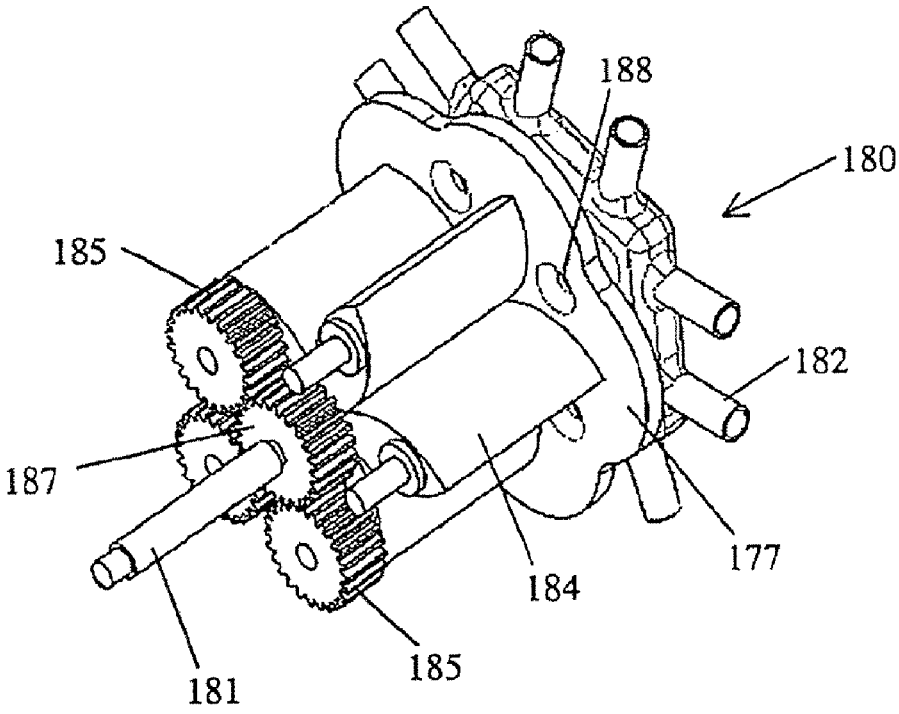
FIG. 38 is a perspective view of a parallel axis pump internals.
Figure 38B:
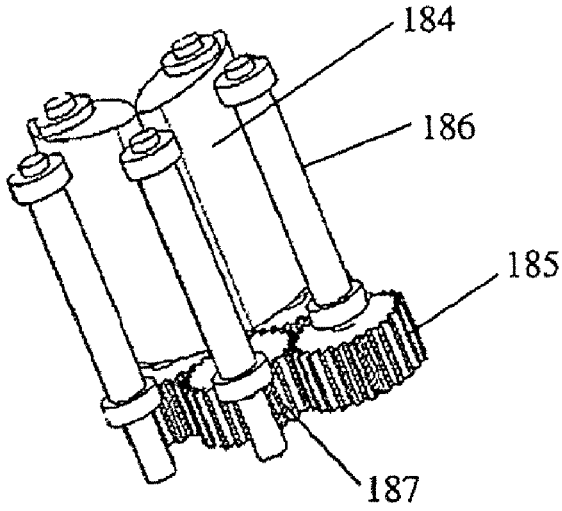

In FIGS. 37, 38*a* and 38*b*, a five rotor pump 175 has a housing 176 having an engine cover 177 at one end of the housing 176 and has an engine body lower cover 178 at the other end. The manifold 180 is mounted on the engine body cover 177 and a rotary shaft 181 extends out from the engine body lower cover 178. Flow ports 182 are on each side of the manifold 188. A plurality of rotor lobes 184 are seen in FIGS. 38*a* and 38*b*, each having a low gear 185 mounted on the end thereof. Each lobe 184 can be seen as mounted to a lobe shaft 186. The rotor shaft 181 is attached to a central drive gear 187 which in turn connects to the rotary lobe gears 185. The inlet/outlet ports 188 can be seen passing through the engine body cover 177 into the manifold 180 in FIG. 40. The pump produces increased pressure to air entering inlet ports 182, as illustrated by the arrows, and increases the inlet air pressure leaving the outlet ports 183 and 190. As seen in FIG. 43, the inner chamber 191 is illustrated at maximum volume with the outer chamber 192 at minimum volume.

FIGS. 37 to 47 shows a five-rotor pump 175 with parallel axes. The concepts of eccentricity allow for the creation of five- and six-rotor machines. The offsetting of the rotation axis creates rotors 184 that present more surface area to the central chamber to extract work from or apply work to. The natural shape of the rotors 184 and their orientations to each other as they go though 360 degrees of rotation create natural openings for the intake or exhausting of materials.

Although the pictured embodiment is of a pump, the concepts and basic machine philosophies can be easily adapted to work as combustion engines also.

A parallel five lobe machine 175 can be configured into (but not limited to) a combustion engine (four- or two-stroke), steam or pneumatic engine, or fluid pump. FIGS. 39 through 47 shows the parallel five-lobe machine 175 in a dual acting pump configuration.

"Dual Acting Pump" refers to a pump that is pumping and sucking fluid simultaneously during various parts of the stroke or cycle of the engine. A piston style dual acting pump is pumping fluid on one side if the piston and sucking fluid on the other. The Parallel Five lobe cycle is based on rotation of the lobes 184 where various positions and sides of the lobes determine whether the lobe is drawing or pushing fluid.

Figure 39:
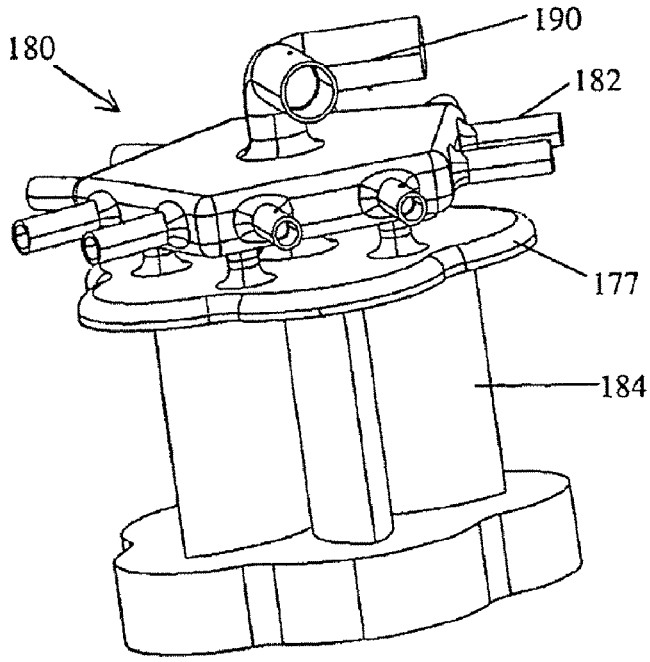
FIG. 39 is a perspective view of the pump lobes and manifold without the exterior casing—fluid direction through ports.
Figure 40:
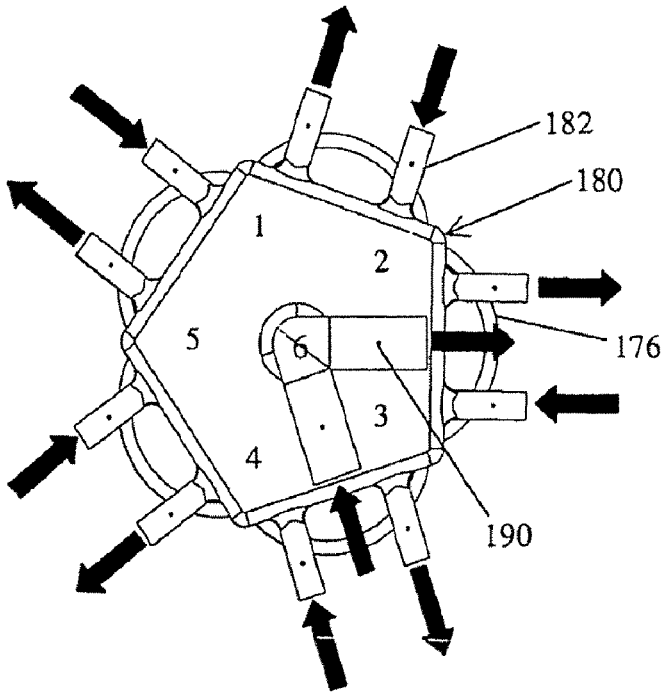
FIG. 40 top elevation of the pump fluid direction through ports.

FIGS. 39-40 show a breakaway diagram and a top view of the parallel five lobe pump 175. The breakaway picture shows the long, eccentric, parallel lobes under the manifold assembly. There are six dual acting ports in the manifold assembly, one 180 in the center with five others 182 in a pentagon arrangement around the center. The top view shows the general vicinity of the port positions by number along with arrows defining the flow direction.

An examination of the pump reveals that there are two distinct chambers within the pump. One chamber 192 is between the lobes and the outer wall of the pump and the other 191 is towards the center of the pump whenever the lobes seal against themselves. During the cycle of the pump, ports 1-5 (182) will always be working in the same direction, meaning that fluid is either coming into the pump 175 through ports 1-5 simultaneously or exiting the pump 175 simultaneously. Whereas port six (190) will always be acting in an opposite manner as compared to ports 1-5. Within the manifold 180, uni-directional valves open and close at each port location. For example, when the inner chamber is sucking fluid, the input valve will open and the output valve will shut automatically (i.e., pressure controlled). The valves would then reverse their position to allow fluid to flow from the pump.

The basic operation of the pump through one complete cycle is as follows.

Figure 41A:
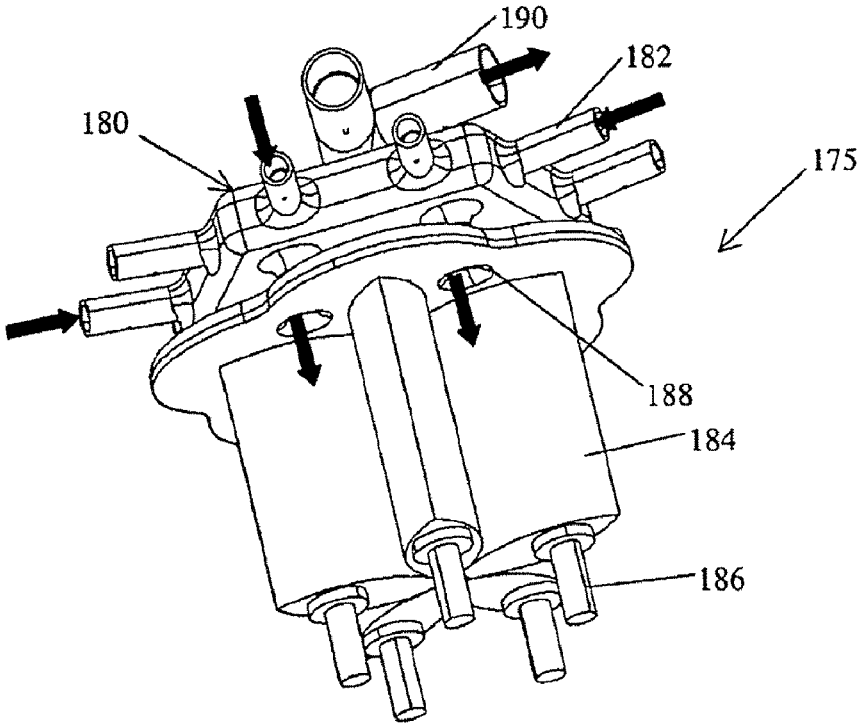
FIG. 41 top elevation of the pump at 0 degrees rotation.
Figure 41B:
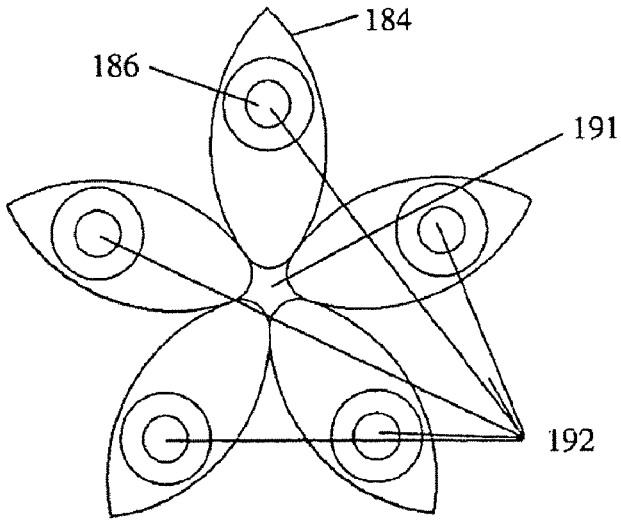

In position #1 of FIGS. 41*a* and 41*b*, the lobes are at Top Dead Center (0 degrees rotation)

This position shows the two chambers of fluid movement. The top dead center position creates the smallest inner chamber 191 area (center of the pump) defined by the tips of the lobes 184. In this position, the smallest amount of fluid exists in the inner chamber 191 with the largest amount of fluid between the sides of the lobes and the sidewalls of the pump housing (outer chambers 192). At the top dead center position, the inner chamber has just finished pumping fluid out and the outer chambers have just finished sucking fluid in.

Figure 42A:
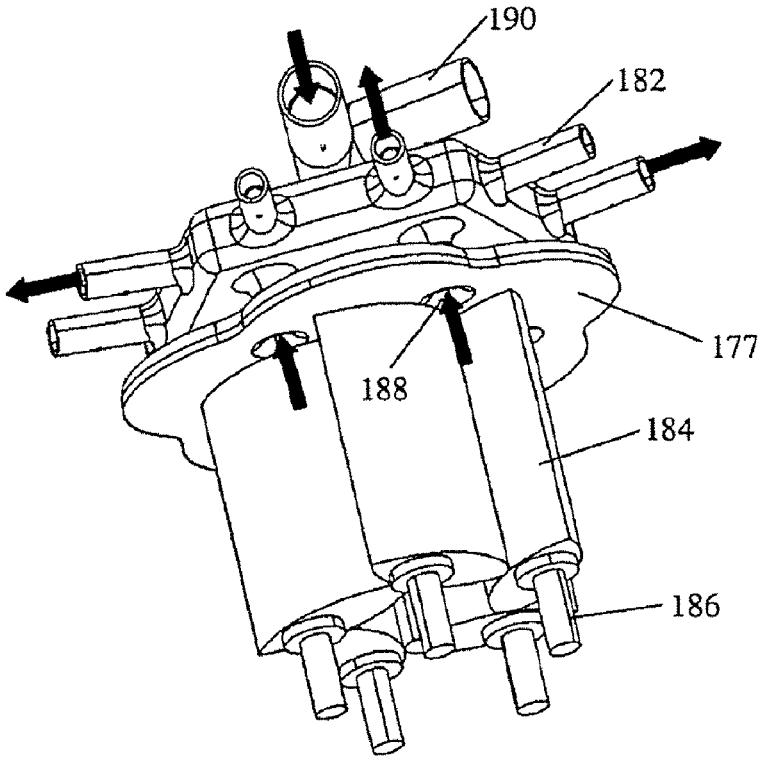
FIG. 42 top elevation of the pump at 45 degrees rotation.
Figure 42B:
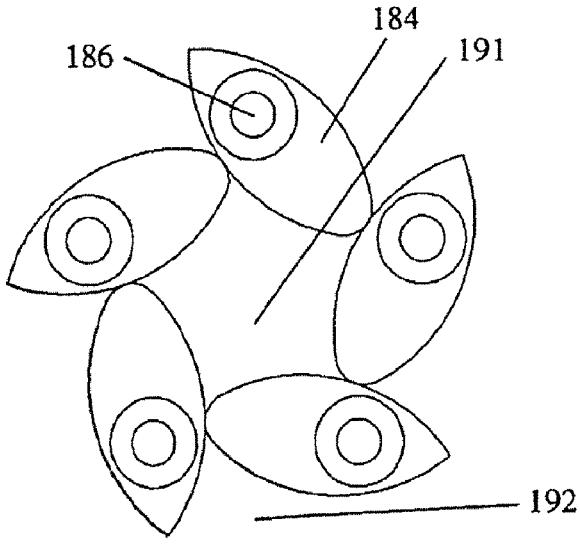

In position #2 of FIGS. 42*a* and 42*b*, the lobes are at 45 Degrees of Rotation in the Power Stroke. As the lobes 184 begin to turn from the top dead center position, fluid is pushed out of the outer chambers and sucked into the center. Notice how the lobe tips remain tangent to the side of the lobe next to it. This is the seal that exists between the inner and outer chambers (191,192) thus creating sucking forces in the middle and pushing forces on the outside. As a note, the entire cavity of the pump, inner and outer chambers, are always full of fluid (i.e., no air pockets) and always have the same total fluid volume.

At each corner of the pentagon shaped manifold 180 is a pair of ports 182. One port is for extracting fluid from a reservoir into the pump (sucking) and the other is for pushing the fluid out of the pump. Inside each port is an automatic valve that will only allow fluid to flow one way based on pressure differentials, i.e., one valve will only open into the pump and the other will open out from the pump.

The sixth pair of ports 190 is in the center of the pump manifold and acts the same as the ports on the corners. The center ports are of a different diameter. The diameters of the ports are adjusted based on the size of the pump, lobe geometry and the amount of eccentricity. The five corner ports 182 are working together and opposite the center port 190, which must be taken into account when calculating flow volumes in and out.

Figure 43A:
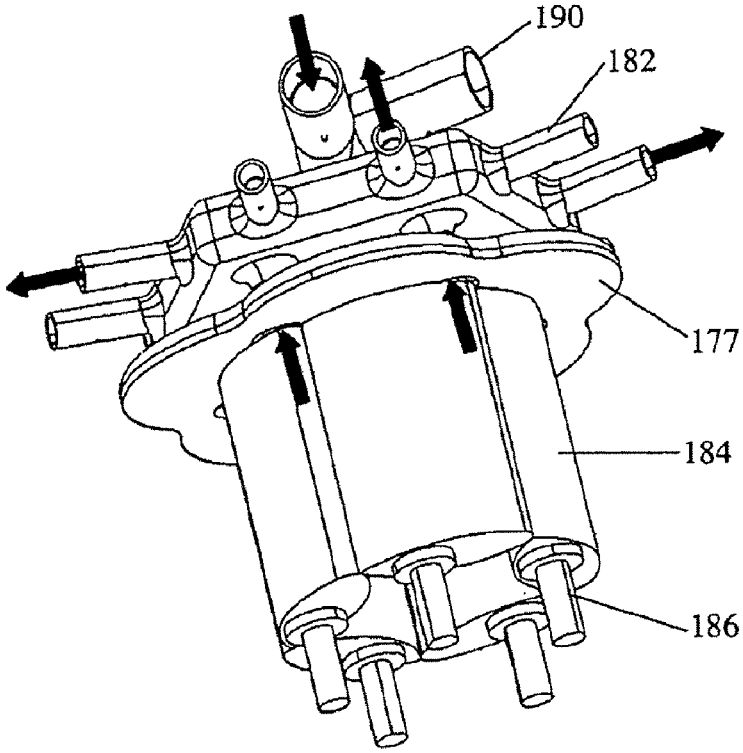
FIG. 43 top elevation of the pump at approximately 90 degrees rotation.
Figure 43B:
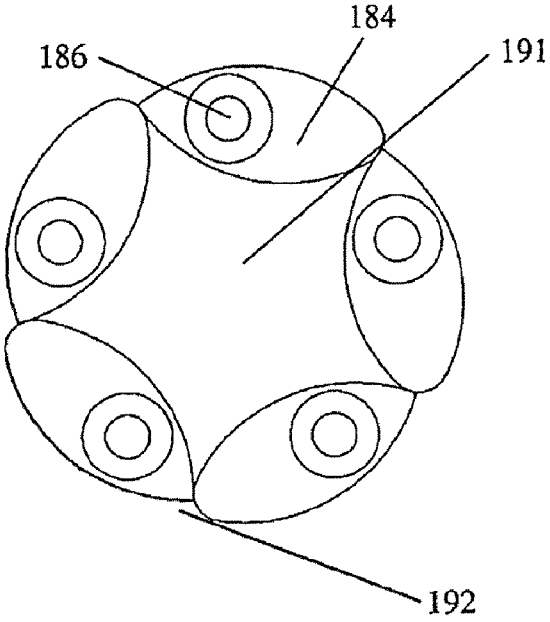

The position shown in FIGS. 43*a* and 43G is about 90 Degrees when tangency is about to Break.

At approximately 90 degrees of rotation, the tangency seal between the lobes 184 is about to separate. The actual angle of rotation that this occurs depends on the tip radius of the lobes 184 and therefore the radius of the sides of the lobe. At this stage, the fluid volume of the inner chamber 191 is at a maximum and the fluid volume of the outer chamber is at a minimum.

This is the end of the work cycle of the pump. For about 180 degrees of rotation (90 to 270 degrees) the tangency connection between the rotors 184 is separated and pressures between the two chambers are equalized.

Figure 44A:
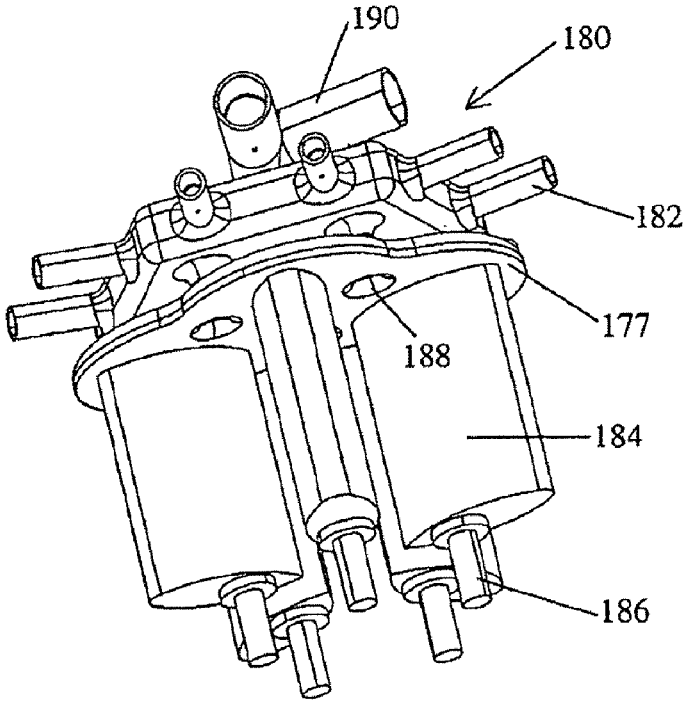
FIG. 44 top elevation of the pump at 180 degrees rotation—no fluid flow.
Figure 44B:
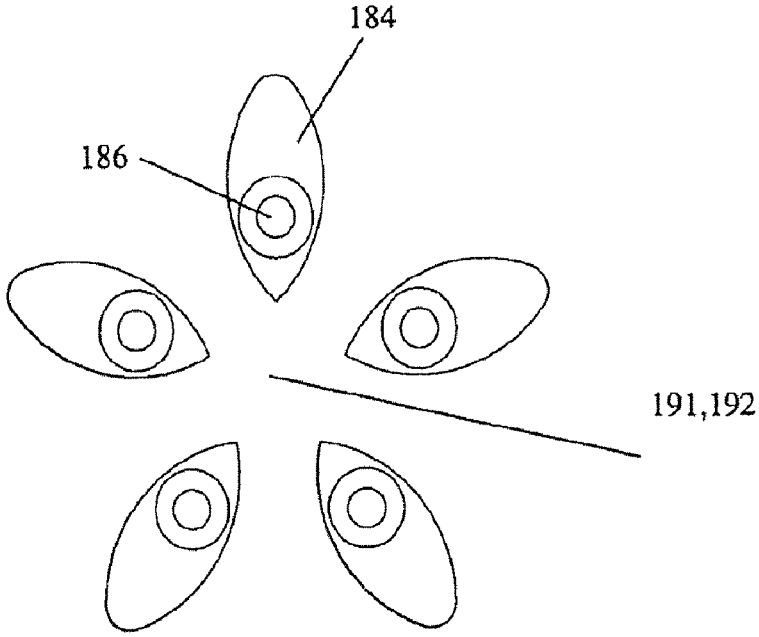

In FIGS. 44*a* and 44*b*, there is a dead zone of approximately 90-270 degrees of rotation.

As the lobes 184 break away from being tangential to one another, the inner and outer chambers (191,192) combine into one big chamber. During this time of "no contact" between the lobes, fluid is not flowing in or out of the pump, therefore resulting in a dead zone of the rotation.

An optional design in a pump configurations would be to combine two five lobe pumps and time them to be 180 degrees out of phase so that there is a continuous pump pressure through an entire cycle and therefore eliminate the dead zone.

Figure 45A:
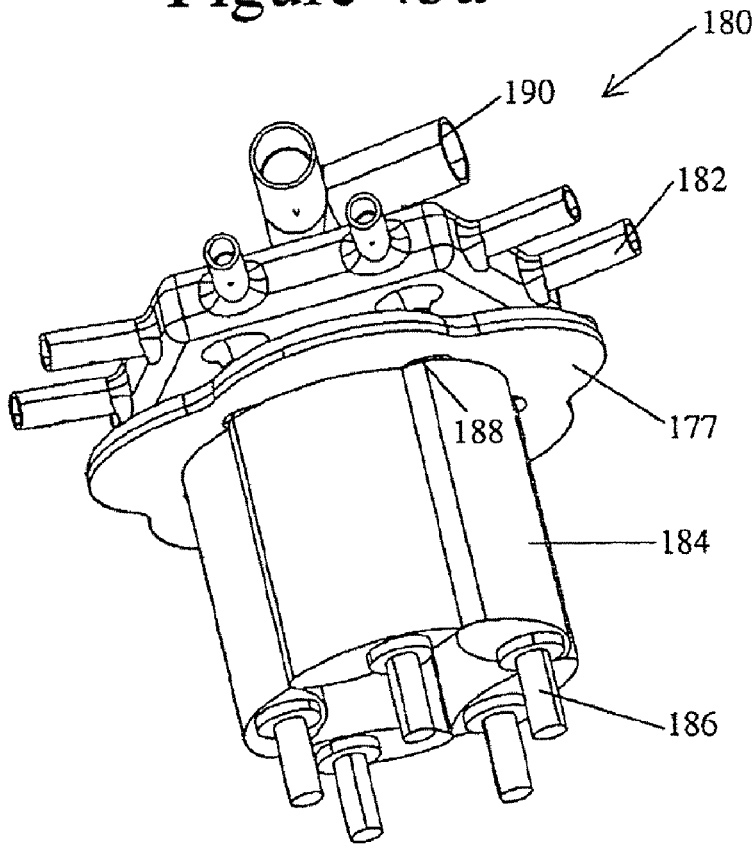
FIG. 45 top elevation of the pump at approximately 270 degrees rotation.
Figure 45B:
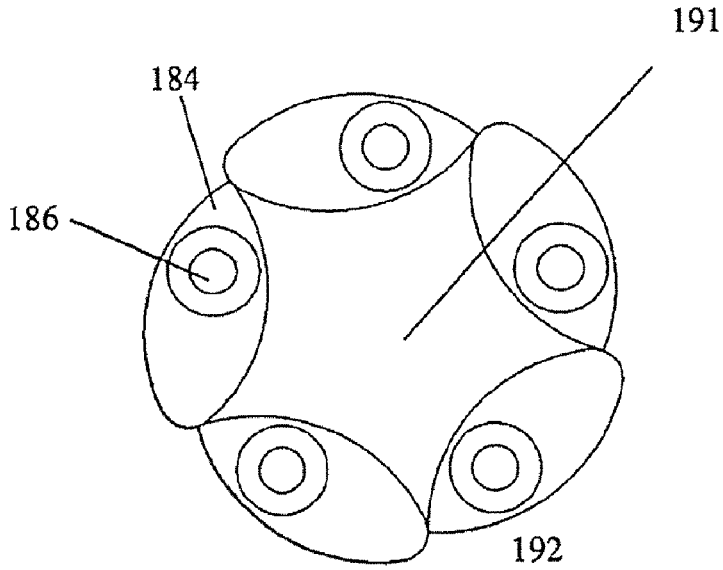

In FIGS. 45*a* and 45*b*, the tangency contact occurs again at approximately 270 degrees.

At the end of the dead zone, contact between the lobes occurs again thus sealing the inner chamber from the outer chamber 192. At this position, the inner chamber 191 is at maximum volume while the outer chamber 192 is at minimum volume. During the next few degrees of rotation, the power stroke of the pump begins, and fluid will begin to be pushed out of the inner chamber 191 and drawn into the outer chamber 192.

Figure 46A:
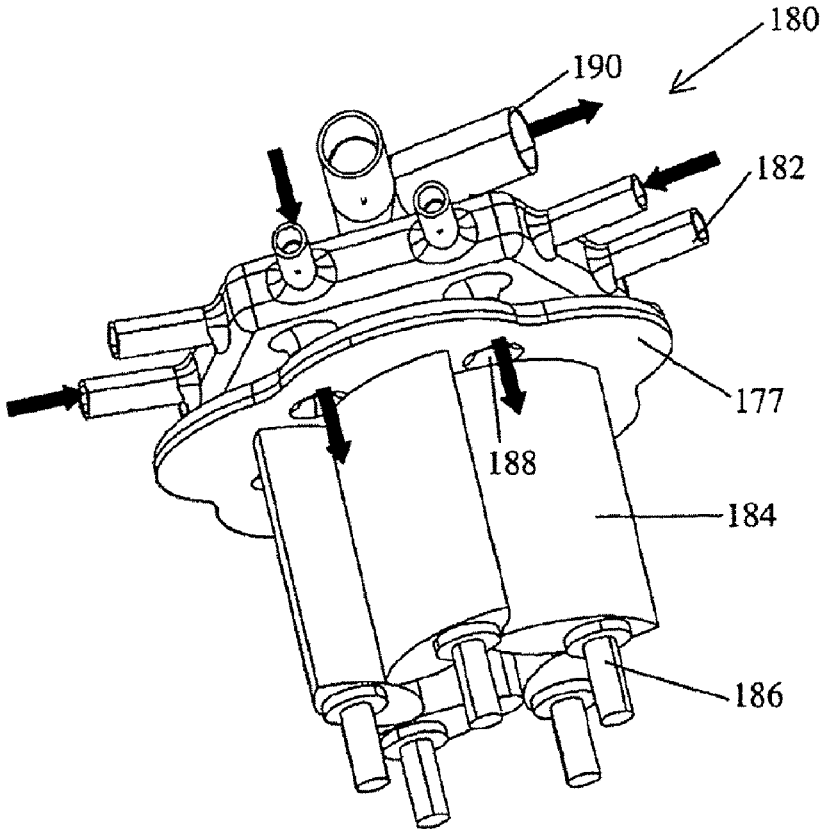
FIG. 46 top elevation of the pump at 315 degrees rotation.
Figure 46B:
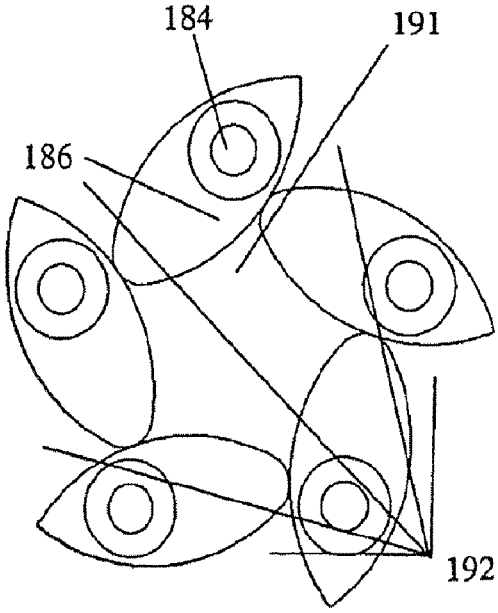
Figure 47:
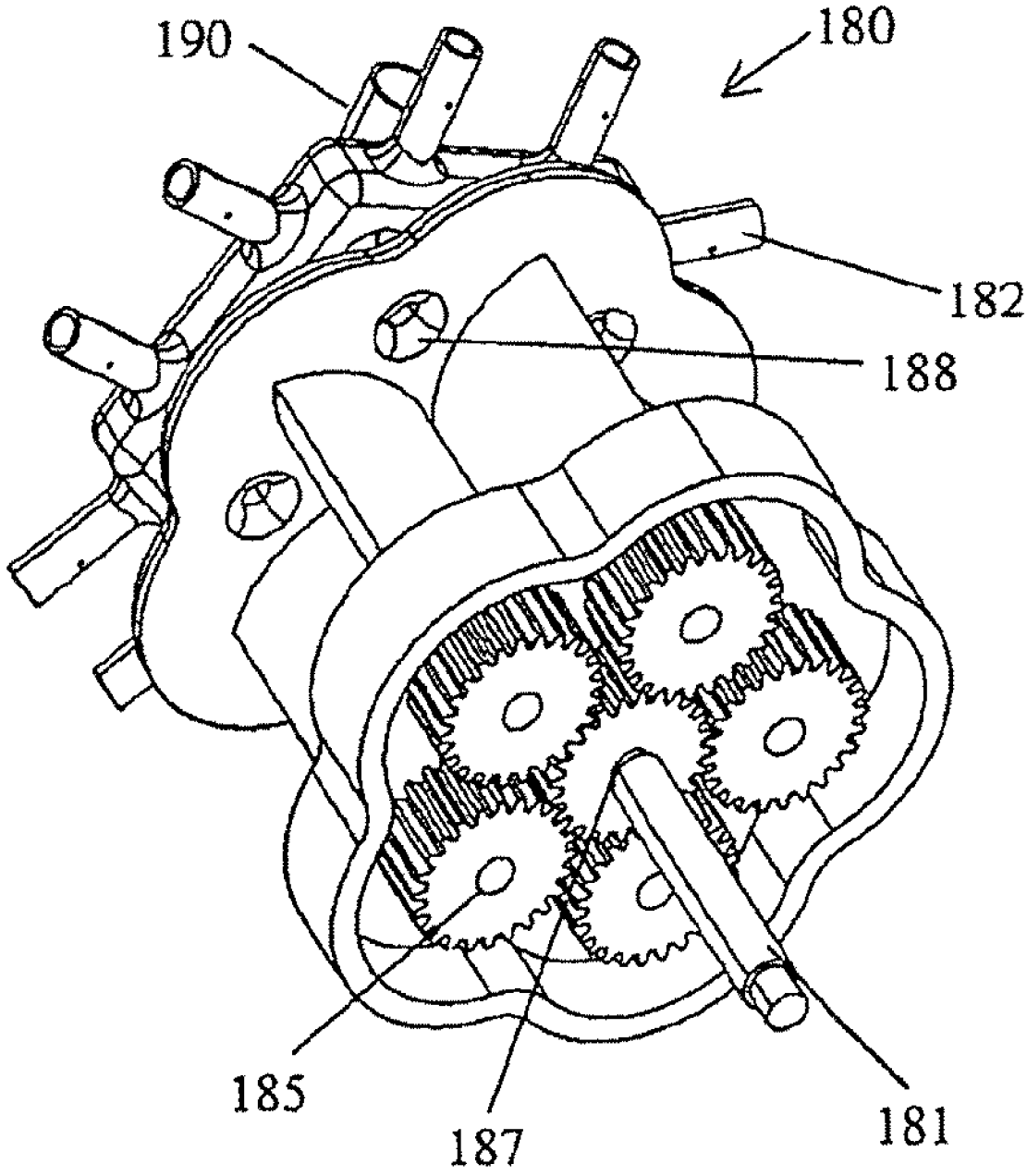
FIG. 47 is a perspective view of a parallel axis pump.

The power stroke is shown in FIGS. 46*a* and 46*b* and is at 315 degrees of rotation.

From 270 through 360 degrees of rotation, the pump 175 is exhausting fluids from the inner chamber 191 and sucking fluids into the outer chambers 192. This is the reverse flow scenario that occurred from 0-90 degrees of rotation.

In summary, the pump is working from 270 degrees through 360 (i.e., 0 degrees) to 90 degrees and is idle from 90 to 270 degrees. The inner chamber 191 switches from pumping to sucking at 0 degrees top dead center at the same time the outer chambers 192 go from sucking to pumping thus the dual acting nature of the pump.

The rotation of the lobes originates from a shaft at the bottom of the pump. The gearing configuration shown is 1:1 but the pump can be geared up or down as required.

I claim:

1. A rotary machine comprising:

a housing;

a plurality of rotor spindles, each of which has centerline about which that rotor spindle rotates, and wherein the plurality of rotor spindles are mounted in said housing with their centerlines aligned along three orthogonal axes;

a plurality of rotor blades, each of which is located on a corresponding different one of the plurality of rotor spindles for rotation therewith, wherein the plurality of rotor blades are arranged relative to each other so that each rotor blade of the plurality of rotor blades is in tangential sliding contact with at least two other rotor blades of the plurality of rotor blades, wherein the plurality of rotor blades forms a plurality of working chambers each having a volume which changes as the rotor spindles of the plurality of rotor spindles rotate;

a gear system including a plurality of internal bevel gears, each of which is located on one end of a corresponding different one of the plurality of rotor spindles, wherein said gear system synchronizes rotation of the rotor spindles during operation; and a central valve mechanism forming a central chamber with the plurality of rotor spindles extending radially outward therefrom and around which the plurality of rotor blades are arranged, wherein said central valve mechanism comprises a valve which during operation of said central valve mechanism controls flow of a fluid between said central chamber and at least one of the plurality of working chambers.

2. The rotary machine of claim 1, wherein the central valve mechanism comprises an inner housing and a plurality of rotary valves within the inner housing wherein said first mentioned valve is one of said plurality of rotary valves.

3. The rotary machine of claim 2, wherein each rotary valve of the plurality of rotary valves includes at least one port through which during operation the fluid travels out into the plurality of working chambers from the central chamber.

4. The rotary machine of claim 2, wherein each rotary value of the plurality of rotary valves includes gear teeth.

5. The rotary machine of claim 4, wherein the central valve mechanism further comprises a plurality of spider gears which mesh with the gear teeth of the rotary valves.

6. The rotary machine of claim 3, wherein the inner housing has a plurality of inlet ports and during operation the ports of the plurality of rotary valves periodically come into alignment with the inlet ports of the inner housing to allow the fluid to pass from the central chamber into the working chambers.

7. The rotary machine of claim 1, wherein one of the plurality of rotor spindles has a passageway along its centerline and opening into the central chamber, said passageway providing a gas intake for introducing the fluid into the central chamber for delivery to the working chambers.

8. The rotary machine of claim 7, is an engine wherein one of the plurality of rotor spindles functions as a rotary output shaft for delivering rotational energy from the engine.

9. The rotary machine of claim 8, wherein the rotor spindle which functions as the rotary output shaft includes said passageway.

10. The rotary machine of claim 1, wherein the plurality of rotor blades are identical.

11. The rotary machine of claim 1, wherein the plurality of rotor blades is six rotor blades and the plurality of rotor spindles is six rotor spindles.

12. The rotary machine of claim 1, wherein the plurality of working chambers is eight working chambers.

13. The rotary machine of claim 1, wherein the housing includes an outer casing surrounding the plurality of rotor blades and the central valve mechanism.

14. The rotary machine of claim 13, is an engine wherein the fluid is a gas and the outer casing includes exhaust ports out of which exhaust gases pass during operation of the engine.

15. The rotary machine of claim 1, wherein the gear system includes a plurality of idle gears coupling the plurality of beveled gears.

16. The rotary machine of claim 1, wherein at least some of the rotor blades include passages which function as exhaust ports during operation.

17. The rotary machine of claim 16, wherein the passages within the rotor blades have an openings in a leading edges of the rotor blades.

* * * * *